US008508557B2

(12) United States Patent
Park et al.

(10) Patent No.: US 8,508,557 B2
(45) Date of Patent: Aug. 13, 2013

(54) ORGANIC LIGHT EMITTING DIODE DISPLAY AND METHOD OF DRIVING THE SAME

(75) Inventors: Bong-Oh Park, Yongin (KR); Sung-Un Park, Yongin (KR); Won-Suk Choi, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 414 days.

(21) Appl. No.: 12/860,816

(22) Filed: Aug. 20, 2010

(65) Prior Publication Data

US 2011/0050751 A1 Mar. 3, 2011

(30) Foreign Application Priority Data

Aug. 27, 2009 (KR) ..... 10-2009-0080040

(51) Int. Cl.
*G09G 5/10* (2006.01)

(52) U.S. Cl.
USPC ..... 345/690

(58) Field of Classification Search
USPC ..... 345/204–215, 690–699
See application file for complete search history.

(56) References Cited

U.S. PATENT DOCUMENTS

| | | | | |
|---|---|---|---|---|
| 6,930,675 | B2 * | 8/2005 | Ishiyama | 345/204 |
| 7,038,668 | B2 * | 5/2006 | Kota et al. | 345/204 |
| 2002/0021295 | A1 * | 2/2002 | Koyama et al. | 345/205 |
| 2002/0075252 | A1 * | 6/2002 | Lee | 345/211 |
| 2002/0163492 | A1 * | 11/2002 | Senda | 345/98 |
| 2002/0163497 | A1 * | 11/2002 | Cunningham et al. | 345/156 |
| 2004/0049533 | A1 * | 3/2004 | Knight | 709/203 |
| 2007/0128899 | A1 * | 6/2007 | Mayer | 439/152 |
| 2008/0150971 | A1 * | 6/2008 | Kienhoefer | 345/690 |
| 2009/0002351 | A1 * | 1/2009 | Kim | 345/204 |
| 2009/0179909 | A1 * | 7/2009 | Fernandez et al. | 345/581 |

FOREIGN PATENT DOCUMENTS

| | | | |
|---|---|---|---|
| JP | 2000-112435 | A | 4/2000 |
| JP | 2003-058130 | A | 2/2003 |
| JP | 2003-099018 | A | 4/2003 |
| JP | 2003-316315 | | 11/2003 |
| JP | 2003316315 | A * | 11/2003 |
| JP | 2004-144819 | A | 5/2004 |
| JP | 2004177557 | A * | 6/2004 |
| JP | 2004-233771 | A | 8/2004 |
| JP | 2005-156960 | A | 6/2005 |
| KR | 10-1998-0702212 | | 7/1998 |
| KR | 10-2001-0006164 | | 1/2001 |
| KR | 10-2002-0090313 | A | 12/2002 |
| KR | 10-2006-0050077 | A | 5/2006 |
| KR | 10-2006-0114476 | | 11/2006 |

(Continued)

*Primary Examiner* — Dwayne Bost
*Assistant Examiner* — Larry Sternbane
(74) *Attorney, Agent, or Firm* — Christie, Parker & Hale, LLP

(57) ABSTRACT

Exemplary embodiments of the present invention relate to an organic light emitting diode (OLED) display and a method of driving the same. The OLED display includes a driving circuit for generating a plurality of data signals and a plurality of scan signals based on image information stored in a memory. The driving circuit receives an inactive state signal generated when the image information is a still image, generates only a plurality of scan signals and a plurality of data signals corresponding to a light emitting region in which the still image is displayed, and transfers the generated scan and data signals to a plurality of corresponding data lines and a plurality of corresponding scan lines, respectively.

37 Claims, 17 Drawing Sheets

(56) References Cited

FOREIGN PATENT DOCUMENTS

| | | |
|---|---|---|
| KR | 10-2006-0124160 | 12/2006 |
| KR | 10-2007-0074791 | 7/2007 |
| KR | 10-2007-0076973 A | 7/2007 |

* cited by examiner

ORGANIC LIGHT EMITTING DIODE DISPLAY AND METHOD OF DRIVING THE SAME

CROSS-REFERENCE TO RELATED APPLICATIONS

This application claims priority to and the benefit of Korean Patent Application No. 10-2009-0080040 filed in the Korean Intellectual Property Office on Aug. 27, 2009, the entire content of which is incorporated herein by reference.

BACKGROUND

1. Field

An aspect of the present invention relates to an organic light emitting diode display including organic light emitting diodes, and a method of driving the same.

2. Description of the Related Art

An organic light emitting diode (OLED) display includes OLEDs (i.e., current driven elements) and driving circuits for controlling current flowing through the OLEDs. In more detail, the driving circuits include a scan driver for sequentially transferring a plurality of scan signals to a plurality of scan lines and a data driver for transferring a plurality of data signals to a plurality of data lines. A plurality of pixels are positioned at a plurality of respective regions at which the plurality of data lines and the plurality of scan lines cross each other, and each pixel includes at least one OLED.

The above information disclosed in this Background section is only for enhancement of understanding of the background of the invention and therefore it may contain information that does not form the prior art that is already known in this country to a person of ordinary skill in the art.

SUMMARY OF THE INVENTION

An aspect of an embodiment of the present invention is directed toward an OLED display and a method of driving the same, wherein the operation of driving circuits is controlled according to an operating state of the OLED display in order to prevent or reduce unnecessary power consumption.

An exemplary embodiment of the present invention provides an OLED display including: a display panel including a plurality of scan lines configured to transfer a plurality of scan signals, a plurality of data lines configured to transfer a plurality of data signals, and a plurality of pixels formed at respective regions where the plurality of scan lines and the plurality of data lines cross; and a driving circuit configured to generate the plurality of data signals and the plurality of scan signals based on image information stored in a memory. The driving circuit receives an inactive state signal generated when the image information is a still image, generates only a plurality of scan signals and a plurality of data signals corresponding to a light emitting region in which the still image is displayed, and transfers the generated scan and data signals to a plurality of corresponding data lines and a plurality of corresponding scan lines, respectively.

The driving circuit may include a gamma block unit configured to generate the plurality of data signals, wherein the gamma block unit includes at least two gamma block drivers. The display panel includes at least two gamma block regions respectively corresponding to the at least two gamma block drivers. When an inactive state signal is received, the driving circuit detects a gamma block region that does not emit light from among the at least two gamma block regions by analyzing the image information, and turns off a gamma block driver corresponding to the detected gamma block region.

The driving circuit may further include a scan driver configured to generate the plurality of scan signals. The driving circuit is configured to control the scan driver such that the plurality of scan signals are respectively transferred to a plurality of scan lines corresponding to the light emitting region by analyzing the image information.

The driving circuit may further include an image information analysis unit configured to perform a column direction data checksum for the image information in a column direction along which the data lines extend in the display panel, to perform a row direction data checksum for the image information in a row direction along which the scan lines extend in the display panel, and to generate light emitting region information including information about the gamma block driver corresponding to the gamma block region that does not emit light based on the column direction data checksum result and information about the plurality of scan signals corresponding to the light emitting region based on the row direction data checksum result. The image information analysis unit is configured to generate the light emitting region information including information about a gamma block driver corresponding to a gamma block region whose column direction data checksum result is 0, from among the at least two gamma block drivers. The image information analysis unit is configured to generate the light emitting region information including information about a plurality of scan lines corresponding to a region whose row direction data checksum result is not 0. First and second synchronization signals synchronized to the inactive state signal are transferred to the memory and the image information analysis unit, respectively. The memory transfers the image information to the image information analysis unit on a frame basis in response to the first synchronization signal. The image information analysis unit operates in response to the second synchronization signal.

The driving circuit of the OLED display according to another exemplary embodiment of the present invention further includes a gamma block controller configured to control the at least two gamma block drivers, and a light emitting region controller including the scan driving controller configured to control the scan driver. The gamma block controller is configured to turn off the gamma block driver corresponding to the gamma block region that does not emit light from among the at least two gamma block drivers. The scan driving controller is configured to control the scan driver so that the plurality of scan signals are sequentially transferred to the plurality of respective scan lines corresponding to the light emitting region.

The driving circuit may include an image information analysis unit configured to perform a column direction data checksum for the image information in a column direction along which the data lines extend in the display panel, to perform a row direction data checksum for the image information in a row direction along which the scan lines extend in the display panel, and to generate light emitting region information including information about the gamma block driver corresponding to the gamma block region that does not emit light based on the column direction data checksum result and information about the plurality of scan signals corresponding to the light emitting region based on the row direction data checksum result. The image information analysis unit is configured to generate the light emitting region information including information about a gamma block driver corresponding to a gamma block region whose column direction data checksum result is 0, from among the at least two gamma block drivers. The image information analysis unit is configured to generate the light emitting region information including information about a plurality of scan lines corresponding to a region whose row direction data checksum result is not 0.

The driving circuit of the OLED display according to yet another exemplary embodiment of the present invention further includes a gamma block unit configured to generate the plurality of data signals, wherein the gamma block unit includes at least two gamma block drivers. The display panel includes at least two gamma block regions respectively corresponding to the at least two gamma block drivers. When the inactive state signal is received, the driving circuit is configured to generate position compensated image information by changing the image information such that a position of the light emitting region is changed on a moving-period basis, detect a gamma block region that does not emit light from among the at least two gamma block regions by analyzing the position compensated image information, turn off a gamma block driver corresponding to the detected gamma block region, and control the gamma block unit such that a gamma block driver corresponding to the light emitting region from among the at least two gamma block drivers generates the plurality of data signals based on the position compensated image information.

The driving circuit in this embodiment further includes a scan driver configured to generate the plurality of scan signals. The driving circuit is configured to control the scan driver such that the plurality of scan signals are respectively transferred to a plurality of scan lines corresponding to the light emitting region by analyzing the position compensated image information. The driving circuit may also include an image information analysis unit configured to perform a column direction data checksum for the position compensated image information in a column direction along which the data lines extend in the display panel, to perform a row direction data checksum for the position compensated image information in a row direction along which the scan lines extend in the display panel, and to generate light emitting region information including information about the gamma block driver corresponding to the gamma block region that does not emit light based on the result of the column direction data checksum and information about the plurality of scan signals corresponding to the light emitting region based on the result of the row direction data checksum. The image information analysis unit is configured to generate the light emitting region information including information about a gamma block driver corresponding to a gamma block region whose column direction data checksum result is 0, from among the at least two gamma block drivers. The image information analysis unit is configured to generate the light emitting region information including information about a plurality of scan lines corresponding to a region whose row direction data checksum result is not 0.

The driving circuit of the OLED display according to another exemplary embodiment of the present invention further includes a gamma block unit configured to generate the plurality of data signals. The gamma block unit includes at least two gamma block drivers. The display panel includes at least two gamma block regions respectively corresponding to the at least two gamma block drivers. When the inactive state signal is received, the driving circuit is configured to generate color compensated image information by performing color compensated and reversal operations on color information of the image information on a color reversal-period basis, detect a gamma block region that does not emit light from among the at least two gamma block regions by analyzing the color compensated image information, turn off a gamma block driver corresponding to the detected gamma block region, and control the gamma block unit so that a gamma block driver corresponding to the light emitting region from among the at least two gamma block drivers generates the plurality of data signals based on the color compensated image information.

The driving circuit in this embodiment may further include a scan driver configured to generate the plurality of scan signals. The driving circuit is configured to control the scan driver such that the plurality of scan signals are respectively transferred to a plurality of scan lines corresponding to the light emitting region by analyzing the color compensated image information.

The driving circuit may further include an image information analysis unit configured to perform a column direction data checksum for the color compensated image information in a column direction along which the data lines extend in the display panel, to perform a row direction data checksum for the color compensated image information in a row direction along which the scan lines extend in the display panel, and to generate light emitting region information including information about the gamma block driver corresponding to the gamma block region that does not emit light based on the result of the column direction data checksum and information about the plurality of scan signals corresponding to the light emitting region based on the result of the row direction data checksum. The image information analysis unit is configured to generate the light emitting region information including information about a gamma block driver corresponding to a gamma block region whose column direction data checksum result is 0, from among the at least two gamma block drivers. The image information analysis unit is configured to generate the light emitting region information including information about a plurality of scan lines corresponding to a region whose row direction data checksum result is not 0.

The driving circuit of the OLED display according to yet another exemplary embodiment of the present invention further includes a gamma block unit configured to generate the plurality of data signals, wherein the gamma block unit includes at least two gamma block drivers. The display panel includes at least two gamma block regions respectively corresponding to the at least two gamma block drivers. When the inactive state signal is received, the driving circuit is configured to generate moving compensated image information such that an image flows in a constant direction within the light emitting region, detects a gamma block region that does not emit light from among the at least two gamma block regions by analyzing the moving compensated image information, turns off a gamma block driver corresponding to the detected gamma block region, and controls the gamma block unit such that a gamma block driver corresponding to the light emitting region from among the at least two gamma block drivers generates the plurality of data signals based on the moving compensated image information.

The driving circuit may further include a scan driver configured to generate the plurality of scan signals. The driving circuit is configured to control the scan driver such that the plurality of scan signals are respectively transferred to a plurality of scan lines corresponding to the light emitting region by analyzing the moving compensated image information.

The driving circuit may further include an image information analysis unit configured to perform a column direction data checksum for the moving compensated image information in a column direction along which the data lines extend in the display panel, to perform a row direction data checksum for the moving compensated image information in a row direction along which the scan lines extend in the display panel, and to generate light emitting region information including information about the gamma block driver corresponding to the gamma block region that does not emit light based on the result of the column direction data checksum and information about the plurality of scan signals corresponding to the light emitting region based on the result of the row direction data checksum. The image information analysis unit is configured to generate the light emitting region information including information about a gamma block driver corresponding to a gamma block region whose column direction data checksum result is 0, from among the at least two gamma block drivers. The image information analysis unit is configured to generate the light emitting region information including information about a plurality of scan lines corresponding to a region whose row direction data checksum result is not 0.

The driving circuit of the OLED display according to yet another exemplary embodiment of the present invention further includes a gamma block unit configured to generate the plurality of data signals, wherein the gamma block unit includes at least two gamma block drivers. The display panel includes at least two gamma block regions respectively corresponding to the at least two gamma block drivers. When the inactive state signal is received, the driving circuit is configured to detect luminance compensated image information for decreasing a luminance of an image within the light emitting region after a predetermined standby period from a point in time at which the inactive state signal is received, detect a gamma block region that does not emit light from among the at least two gamma block regions by analyzing the luminance compensated image information, turn off a gamma block driver corresponding to the detected gamma block region, and control the gamma block unit such that a gamma block driver corresponding to the light emitting region from among the at least two gamma block drivers generates the plurality of data signals based on the luminance compensated image information.

The driving circuit further includes a scan driver configured to generate the plurality of scan signals. The driving circuit is configured to control the scan driver such that the plurality of scan signals are respectively transferred to a plurality of scan lines corresponding to the light emitting region by analyzing the luminance compensated image information. The driving circuit may further include an image information analysis unit configured to perform a column direction data checksum for the luminance compensated image information in a column direction along which the data lines extend in the display panel, to perform a row direction data checksum for the luminance compensated image information in a row direction along which the scan lines extend in the display panel, and to generate light emitting region information including information about the gamma block driver corresponding to the gamma block region that does not emit light based on the column direction data checksum result and information about the plurality of scan signals corresponding to the light emitting region based on the row direction data checksum result. The image information analysis unit is configured to generate the light emitting region information including information about a gamma block driver corresponding to a gamma block region whose column direction data checksum result is 0, from among the at least two gamma block drivers. The image information analysis unit is configured to generate the light emitting region information including information about a plurality of scan lines corresponding to a region whose row direction data checksum result is not 0.

An OLED display according to an exemplary embodiment of the present invention includes a display panel including a plurality of scan lines for transferring a plurality of scan signals and a plurality of data lines for transferring a plurality of data signals, a memory configured to store image information, and at least two gamma block drivers configured to control at least two gamma block regions of the display panel, respectively, and each transfer the plurality of data signals to each of the respective at least two gamma block regions. A method of driving the OLED display according to this exemplary embodiment of the present invention includes determining whether an inactive state signal generated when the image information stored in the memory is a still image has been received, if, as a result of the determination, the inactive state signal is determined to have been received, performing a column direction data checksum for the image information in a column direction where the plurality of data lines is formed, determining whether the column direction data checksum is 0, turning off a gamma block driver corresponding to a gamma block region whose column direction data checksum is 0 from among the at least two gamma block drivers, if, as a result of the determination, the inactive state signal is determined to have been received, performing a row direction data checksum for the image information in a row direction where the plurality of scan lines extend, and controlling the plurality of scan signals based on the row direction data checksum such that the plurality of scan signals are sequentially transferred to a plurality of respective scan lines corresponding to a light emitting region in which the still image is displayed.

The method of driving the OLED display further includes if, as a result of the determination, the inactive state signal is determined to have been received, changing the image information such that a position of the light emitting region is changed on a moving-period basis and generating position compensated image information. The performing of the column direction data checksum and the performing of the row direction data checksum use the position compensated image information.

The method of driving the OLED display further includes if, as a result of the determination, the inactive state signal is determined to have been received, generating color compensated image information by performing compensated color and reversal operations on color information of the image information on a color reversal-period basis. The performing of the column direction data checksum and the performing of the row direction data checksum use the color compensated image information.

The method of driving the OLED display further includes if, as a result of the determination, the inactive state signal is determined to have been received, generating moving compensated image information such that an image flows in a constant direction within the light emitting region. The performing of the column direction data checksum and the performing of the row direction data checksum use the moving compensated image information.

The method of driving the OLED display further includes if, as a result of the determination, the inactive state signal is determined to have been received, generating luminance compensated image information for decreasing a luminance of an image within the light emitting region after a predetermined standby period from a point in time at which the inactive state signal has been input. The performing of the column direction data checksum and the performing of the row direction data checksum use the luminance compensated image information.

As described above, the exemplary embodiments of the present invention provide the OLED display and the method of driving the same, which are capable of reducing power consumption in an inactive state and preventing or reducing image sticking.

DETAILED DESCRIPTION

Figure 1:
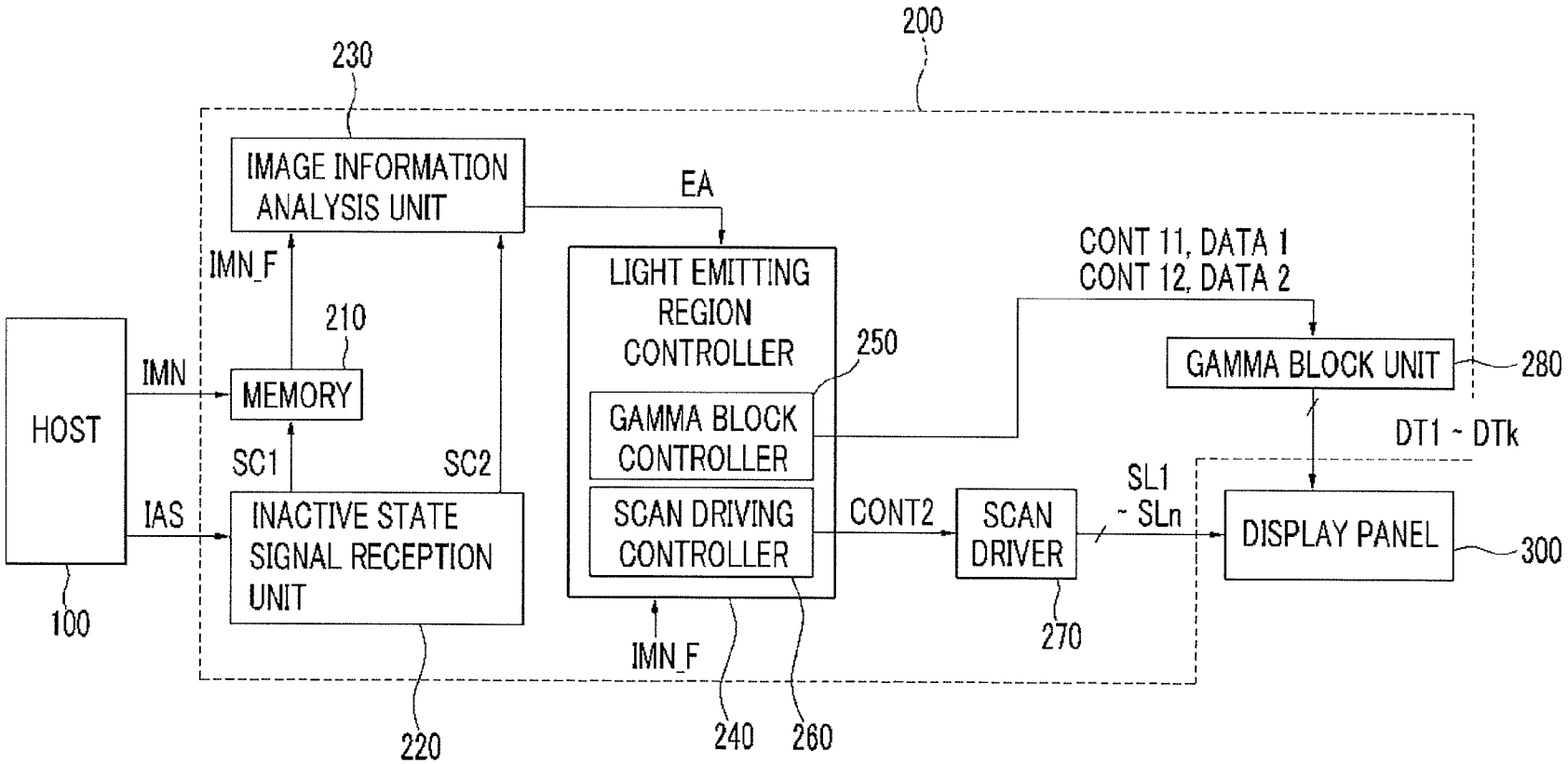
FIG. 1 is a diagram schematically showing the configuration of an OLED display according to a first exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

The driving circuit of a typical OLED display is configured to process image information received irrespective of an operating state of the OLED display and to transfer a plurality of scan signals and a plurality of data signals to a plurality of pixels. However, such an operation causes unnecessary power consumption because the operation is maintained in an inactive state in which there is no change in the image information inputted to the OLED display. In the case where the OLED display is applied to a mobile phone, in an inactive state, the OLED display displays only time and date information. In order to display such simple information, all the driving circuits generate and output the scan signals and the data signals to not only cause unnecessary power consumption, but also to reduce the lifespan of the driving circuits.

Figure 2:
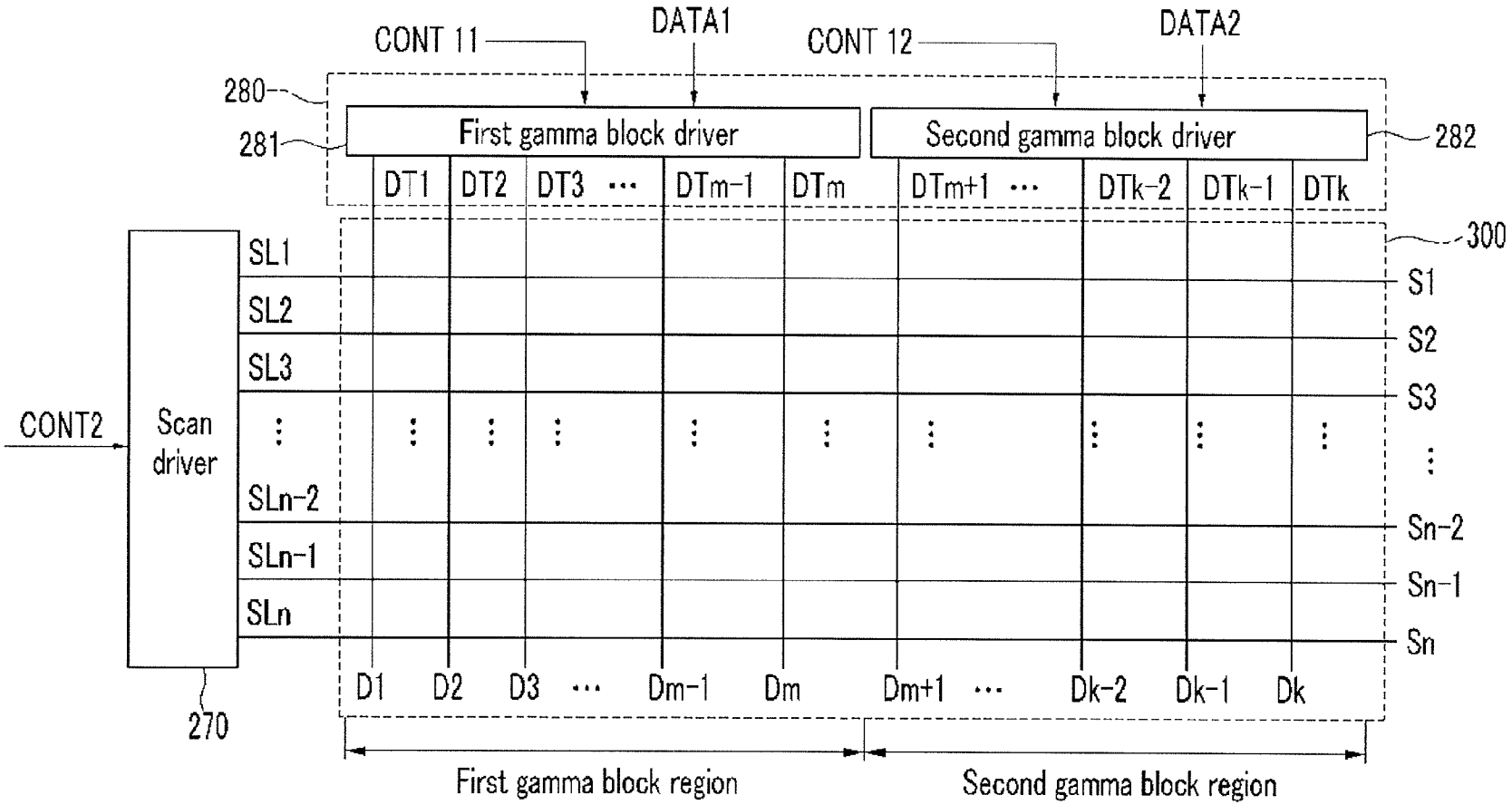
FIG. 2 is a detailed schematic diagram showing a gamma block unit 280, a scan driver 270, and a display panel 300 according to the first exemplary embodiment of the present invention.

FIG. 1 is a diagram schematically showing the configuration of an organic light emitting diode (OLED) display according to a first exemplary embodiment of the present invention. FIG. 2 is a detailed diagram schematically showing a gamma block unit 280, a scan driver 270, and a display panel 300 according to the first exemplary embodiment of the present invention.

As shown in FIG. 1, the OLED display includes a host 100, a driving circuit 200, and the display panel 300.

The host 100 converts an externally inputted image signal into image information IMN that is suitable for the OLED display. The host 100 converts the input image signal into the image information IMN according to the resolution of the OLED display. The image information IMN includes a horizontal synchronization signal and a vertical synchronization signal. The vertical synchronization signal is a synchronization signal to distinguish frames from each other. The horizontal synchronization signal is a synchronization signal to control a point in time at which a plurality of scan signals are sequentially transferred to a plurality of scan lines of the display panel 300 while an image of one frame is displayed on the entire display panel. The host 100 generates an inactive state signal IAS that is indicative of an inactive state when an externally inputted image signal is a still image. In the case where equipment using the OLED display is a mobile phone, in the inactive state, only regions of the display panel 300 where pieces of information such as the current time, date, battery power, and reception sensitivity are displayed are operated.

The driving circuit 200 generates the plurality of scan signals and the plurality of data signals according to the image information IMN and supplies them to the display panel 300. The driving circuit 200 includes a memory 210, an inactive state signal reception unit 220, an image information analysis unit 230, a light emitting region controller 240, the scan driver 270, and the gamma block unit 280.

When the inactive state signal IAS is received, the inactive state signal reception unit 220 informs the image information analysis unit 230 and the memory 210 that the OLED display is in the inactive state. When the inactive state signal IAS is received, the inactive state signal reception unit 220 transfers a first synchronization signal SC1 and a second synchronization signal SC2 to the memory 210 and the image information analysis unit 230, respectively. The first synchronization signal SC1 and the second synchronization signal SC2 are signals that have been synchronized to each other, and they can be implemented using respective synchronization signals each periodically having a pulse of a specific level at the same point in time.

The memory 210 reads the image information IMN from the host 100 and stores the read image information IMN. The memory 210 stores the image information IMN per one frame unit and transfers stored image information IMN_F to the light emitting region controller 240. Hereinafter, image information inputted to the memory 210 is indicated by "IMN", and image information outputted from the memory 210 is indicated by "IMN_F". The memory 210 includes at least two regions. One of the two regions functions to store the image information IMN read from the host 100 per one frame unit, and the other of the two regions functions to output the stored image information IMN_F of one frame unit to the light emitting region controller 240. When the first synchronization signal SC1 is received from the inactive state signal reception unit 220, the memory 210 transfers the stored image information IMN_F to external constituent elements, such as the image information analysis unit 230, per one frame unit in response to the first synchronization signal SC1. The external constituent elements are described in detail below with reference to exemplary embodiments.

The image information analysis unit 230 operates in response to the second synchronization signal SC2. The image information analysis unit 230 starts operating at a point in time at which the second synchronization signal SC2 is generated, and analyzes the image information IMN_F in response to the second synchronization signal SC2. The image information analysis unit 230 distinguishes a light emitting region and a non-light emitting region in the display panel by analyzing the image information IMN_F received from the memory 210. The image information analysis unit 230 transfers information about the light emitting region (hereinafter referred to as a "light emitting region information EA") to the light emitting region controller 240. The memory 210 transfers the image information IMN_F about a frame where the inactive state signal IAS has been generated to the image information analysis unit 230 in response to the first synchronization signal SC1. The image information analysis unit 230 can analyze the image information IMN_F of an inactive state by analyzing the received image information IMN_F in response to the second synchronization signal SC2. The image information analysis unit 230 generates the light emitting region information EA based on a result of a data checksum that has been performed in a direction along which the data lines extend in the display panel (hereinafter referred to as a "column direction") and a result of a data checksum that has been performed in a direction along which the scan lines extend in the display panel (hereinafter referred to as a "row direction"). The above operation will be described in detail below with reference to FIG. 2.

As shown in FIG. 2, the gamma block unit 280 generates a plurality of data signals DT1-DTk in response to first and second driving control signals CONT11 and CONT12 and first and second image data signals DATA1 and DATA2 received from the gamma block controller 250, and transfers the plurality of data signals DT1-DTk to the plurality of data lines D1-Dk. The gamma block unit 280 according to the exemplary embodiment of the present invention includes at least two gamma block drivers. Each of the gamma block drivers transfers the plurality of data signals to the plurality of respective data lines of a corresponding region from among the regions of the display panel 300. A panel region corresponding to each gamma block driver is hereinafter referred to as a gamma block region. In the first exemplary embodiment of the present invention, it is assumed that the gamma block unit 280 includes first and second gamma block drivers 281 and 282. It is however to be noted that the present invention is not limited thereto. The first gamma block driver 281 transfers the plurality of data signals DT1-DTm to the plurality of respective data lines D1-Dm, and the second gamma block driver 282 transfers the plurality of data signals DTm+1-DTk to the plurality of respective data lines Dm+1-Dk. Thus, the display panel 300 includes a first gamma block region and a second gamma block region. The driving control signal CONT11 is a signal for indicating a point in time at which the first gamma block driver 281 transfers the plurality of data signals DT1-DTm to the plurality of respective data lines D1-Dm. The image data signal DATA1 includes information about the plurality of data signals DT1-DTm. The driving control signal CONT12 is a signal for indicating a point in time at which the second gamma block driver 282 transfers the plurality of data signals DTm+1-DTk to the plurality of respective data lines Dm+1-Dk. The image data signal DATA2 includes information about the plurality of data signals DTm+1-DTk.

The scan driver 270 sequentially transfers the plurality of scan signals to the plurality of respective scan lines in response to a scan driving control signal CONT2. The scan driving control signal CONT2 is a signal to control the scan driver 270 such that all the scan signals can be transferred to all the scan lines during a period in which an image of one frame is displayed. The scan driving control signal CONT2 is generated in synchronization with the horizontal synchronization signal.

The image information analysis unit 230 detects the light emitting region by performing the column direction data checksum and then the row direction data checksum. In an inactive state, when the second synchronization signal SC2 is received, the image information analysis unit 230 produces a column direction data checksum for each of the first gamma block region and the second gamma block region. A gamma block region whose data checksum is 0 corresponds to a non-light emitting region, and a gamma block region whose data checksum is not 0 corresponds to a light emitting region.

Similarly, a region whose row direction data checksum result is 0 corresponds to a non-light emitting region, and so the scan signals are not supplied to the region. A region whose row direction data checksum result is not 0 corresponds to a light emitting region, and so the scan signals are supplied to the region. That is, the image information analysis unit 230 generates information about a plurality of scan lines corresponding to a light emitting region whose row direction data checksum result is not 0.

The image information analysis unit 230 generates information about a gamma block driver of a non-light emitting region through a column direction data checksum result in the inactive state, and generates information about a plurality of scan lines corresponding to a light emitting region through a row direction data checksum result. The light emitting region information according to an exemplary embodiment of the present invention includes information about the gamma block driver of a non-light emitting region and information about a plurality of scan lines corresponding to a light emitting region. However, the present invention is not limited to the above information, and may include any information as long as it can indicate the position of a light emitting region.

The image information analysis unit 230 transfers the light emitting region information EA to the light emitting region controller 240.

In the case where the OLED display is not in the inactive state (hereinafter referred to as a "normal state"), the light emitting region controller 240 controls the gamma block unit 280 and the scan driver 270 based on the image information IMN_F received from the memory 210. In the inactive state, the light emitting region controller 240 controls the scan driver 270 and the gamma block unit 280 such that an image is displayed only in the light emitting region according to the light emitting region information EA. The light emitting region controller 240 includes a gamma block controller 250 and a scan driving controller 260.

In the normal state, the gamma block controller 250 generates the first and second driving control signals CONT11 and CONT12 and the first and second image data signals DATA1 and DATA2 in response to the image information IMN, and transfers them to the gamma block unit 280. In the inactive state, the gamma block controller 250 controls the gamma block unit 280 in response to the light emitting region information EA so that a plurality of data signals are transferred to only a light emitting region. In more detail, the gamma block controller 250 turns off a gamma block driver in which an image is not displayed and turns on a gamma block driver in which an image is displayed.

In the normal state, the scan driving controller 260 generates the scan driving control signal CONT2 according to the image information IMN_F and transfers the generated scan driving control signal CONT2 to the scan driver 270. In the inactive state, the scan driving controller 260 controls the scan driver 270 based on the image information IMN_F and the light emitting region information EA so that a plurality of scan signals are sequentially transferred to only a light emitting region.

A case where the number of gamma block drivers is two has been described as an example thus far, but the present invention is not limited thereto. For example, the number of gamma block drivers may be two or more, and the number of gamma block regions are increased according to an increase in the number of gamma block drivers.

An operation mode where the driving circuit 200 operates in the normal state is called a normal mode, and an operation mode where the driving circuit 200 operates in the inactive state is called an inactive state mode.

A method of displaying an image in a light emitting region in the inactive state in the OLED display according to the first exemplary embodiment of the present invention is described below with reference to FIG. 3.

Figure 3:
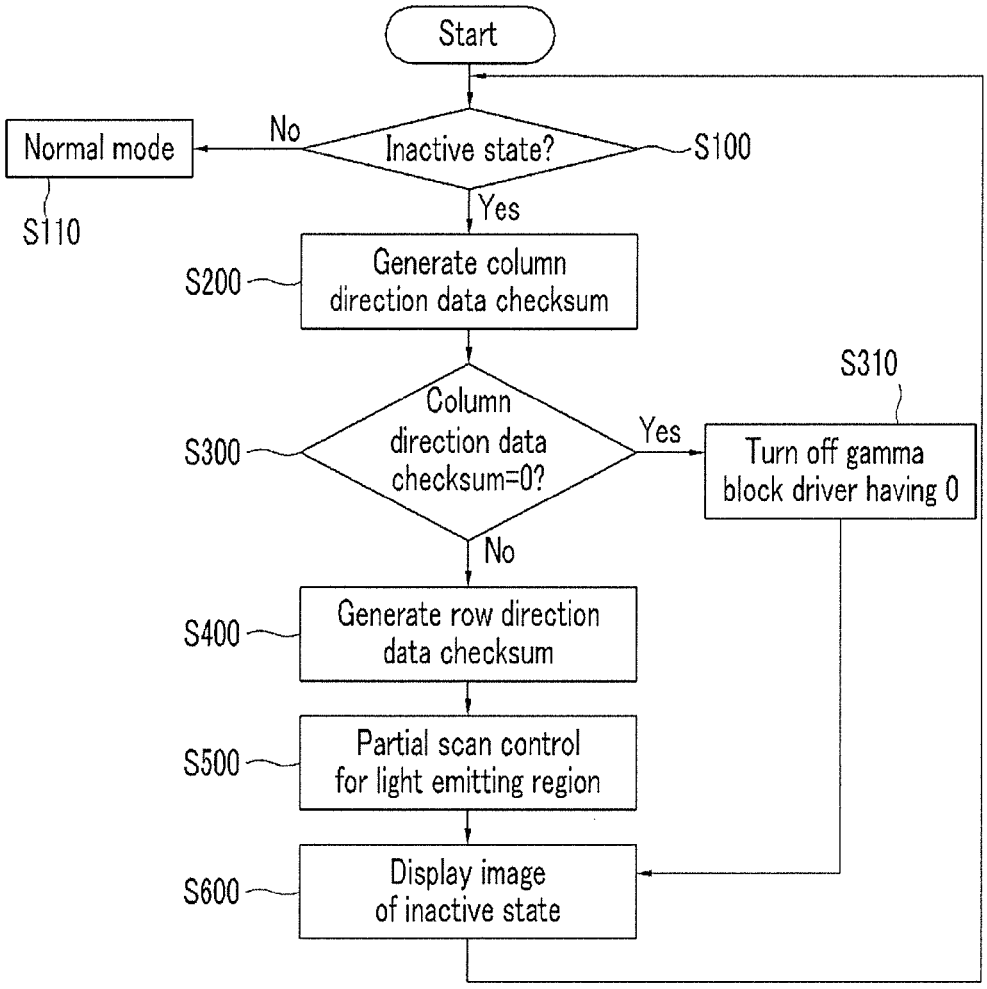
FIG. 3 is a flowchart illustrating an operation of the OLED display according to the first exemplary embodiment of the present invention.

FIG. 3 is a flowchart illustrating an operation of the OLED display according to the first exemplary embodiment of the present invention.

As shown in FIG. 3, it is first determined whether or not the OLED display is in the inactive state by determining whether or not the inactive state signal IAS has been received at step S100. If the inactive state signal IAS is not received, the OLED display is in the normal state. Thus, the OLED display operates in the normal mode at step S110. If, as a result of the determination at step S100, the OLED display is determined to be in the inactive state, the image information analysis unit 230 produces a column direction data checksum according to each gamma block region based on the image information IMN_F received from the memory 210 at step S200. The gamma block controller 250 determines whether the column direction data checksum is 0 at step S300. If, as a result of the determination at step S300, the column direction data checksum is determined to be 0, the gamma block controller 250 turns off a corresponding gamma block driver at step S310. If, as a result of the determination at step S300, the column direction data checksum is determined not to be 0, the image information analysis unit 230 produces a row direction data checksum based on the image information IMN_F at step S400. The light emitting region information EA generated as a result of the step S400 is transferred to the scan driving controller 260, and the scan driving controller 260 controls partial scanning for a light emitting region at step S500. The gamma block unit 280 and the scan driver 270 transfer a plurality of scan signals and a plurality of data signals to the light emitting region of the display panel. An image of the inactive state is displayed in the light emitting region at step S600. The above operation is continuously repeated for each frame.

Figure 4:
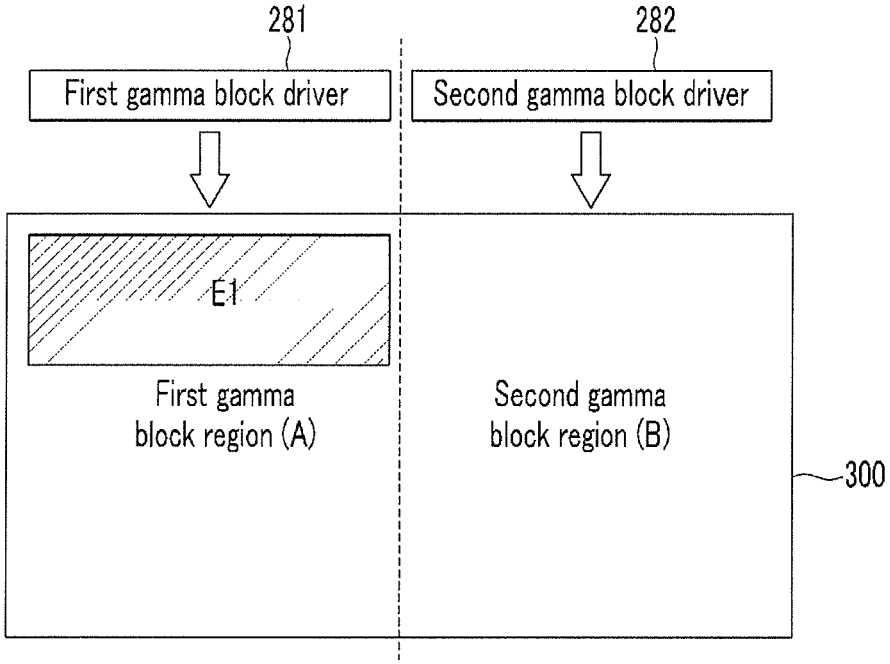
FIG. 4 is a diagram showing that the display panel of the first exemplary embodiment is divided into a first gamma block region A and a second gamma block region B.

FIG. 4 is a diagram showing that the display panel 300 is divided into, as an example, a first gamma block region A and a second gamma block region B.

In FIG. 4, a light emitting region and a non-light emitting region are determined according to a column direction data checksum of the first gamma block region A and a column direction data checksum result of the second gamma block region B. Assuming that a light emitting region E1 is placed in the first gamma block region A and the column direction data checksum of the second gamma block region B is 0, then the second gamma block driver 282 does not operate, and the second gamma block region B is turned off.

Figure 5:
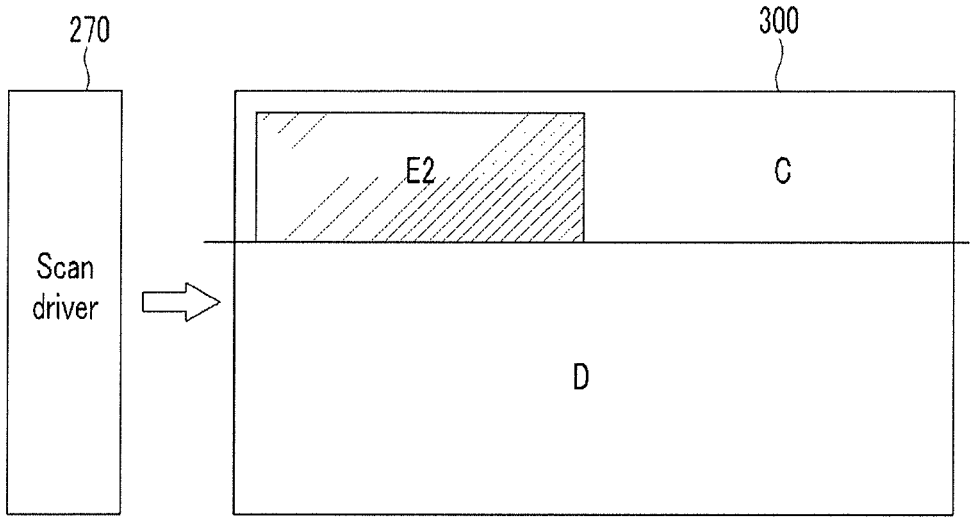
FIG. 5 is a diagram showing a region C to which scan signals are transferred and a region D to which scan signals are not transferred in the display panel according to the first exemplary embodiment.

FIG. 5 is a diagram showing a region C to which scan signals are transferred and a region D to which scan signals are not transferred in the display panel. Assuming that the light emitting region E1 is placed in the first gamma block region A as in FIG. 4, the region D becomes a region where image signals are not displayed according to a row direction data checksum result. Then, the scan driver 270 does not transfer scan signals to the region D, and sequentially transfers a plurality of scan signals to a plurality of scan lines corresponding to the region C in response to the scan driving control signal CONT2.

As described above, the driving circuit of the OLED display according to the first exemplary embodiment of the present invention turns off the operation of the gamma block driver and limits a scan region in an inactive state, thereby being capable of preventing or reducing power consumption. If the inactive state is maintained for a long period of time, the same image is displayed in the display panel for a long period of time. In this case, an image sticking phenomenon occurs, which may damage the display panel.

In the second exemplary embodiment of the present invention, an OLED display that is capable of reducing power consumption and preventing or reducing the image sticking phenomenon is described. The OLED display according to the second exemplary embodiment of the present invention changes the position of an image that is displayed in the inactive state on a moving-period basis. The OLED display according to the second exemplary embodiment of the present invention is described below with reference to FIGS. 6 and 7.

Figure 6:
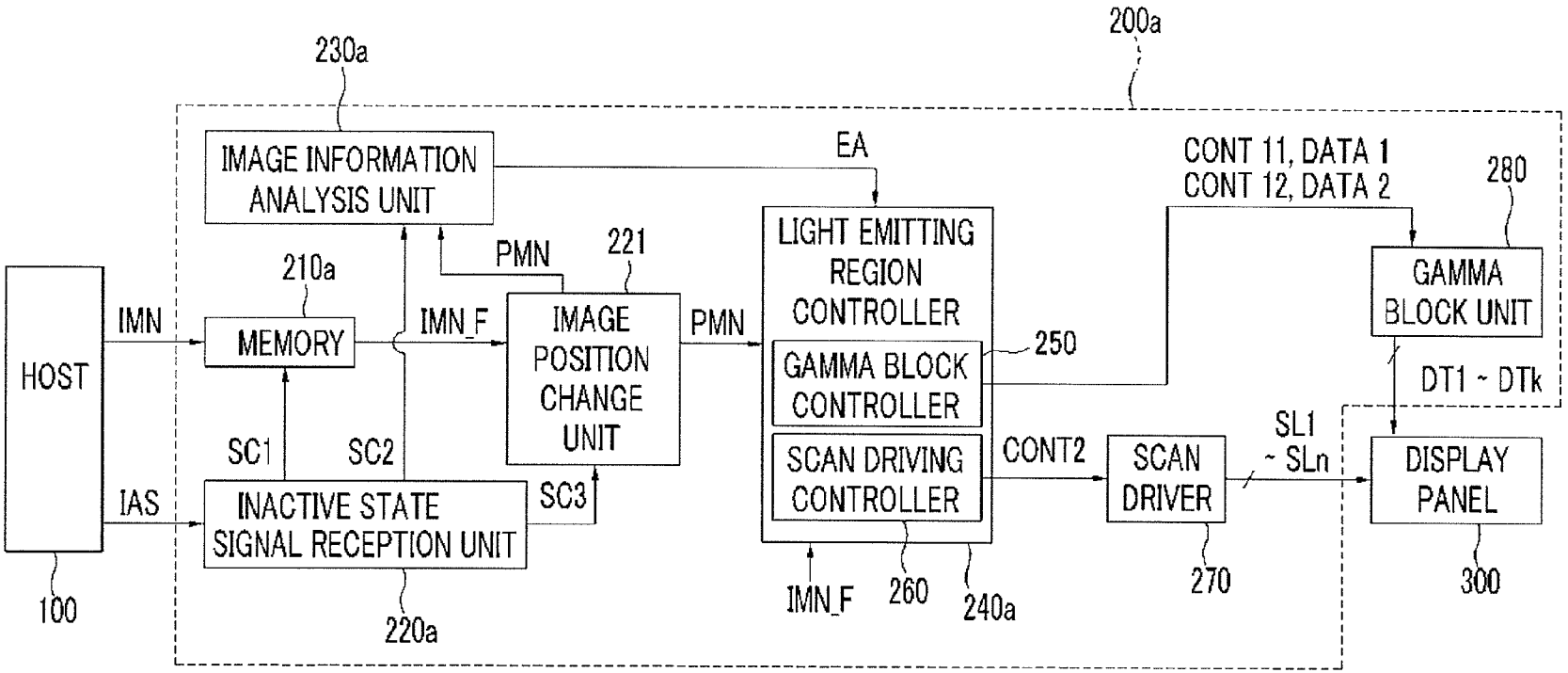
FIG. 6 is a schematic diagram showing an OLED display according to a second exemplary embodiment of the present invention.

FIG. 6 is a schematic diagram showing the OLED display according to the second exemplary embodiment of the present invention. As shown in FIG. 6, the driving circuit 200*a* according to the second exemplary embodiment of the present invention further includes an image position change unit 221, when compared to the first exemplary embodiment. A redundant description of the driving circuit 200*a* when compared to the first exemplary embodiment is omitted for simplicity.

When the inactive state signal IAS is received, the inactive state signal reception unit 220*a* generates a third synchronization signal SC3, together with the first and second synchronization signals SC1 and SC2, and transfers the first and second synchronization signals SC1 and SC2 to the memory 210*a* and the image information analysis unit 230*a*, respectively, and the third synchronization signal SC3 to the image position change unit 221.

The image position change unit 221 changes the image information IMN_F such that the position of a light emitting region where an image is displayed during the inactive state is changed on a moving-period basis, and generates position compensated image information PMN. When the third synchronization signal SC3 is received, the image position change unit 221 starts operating. The image position change unit 221 compares the image information IMN_F received from the memory 210*a* with an address where information about a plurality of data signals is written and changes the address on a moving-period basis to generate the position compensated image information PMN. That is, actual information about a plurality of data signals is not changed. The image position change unit 221 changes the image information IMN_F on a moving-period basis from a point in time at which the inactive state begins, and generates the position compensated image information PMN.

The image information analysis unit 230*a* analyzes the position compensated image information PMN and generates the light emitting region information EA during the inactive state. A method for the image information analysis unit 230*a* to generate the light emitting region information EA is the same as that of the first exemplary embodiment.

The light emitting region controller 240*a* receives the position compensated image information PMN during the inactive state, and controls the gamma block unit 280 and the scan driver 270 based on the position compensated image information PMN and the light emitting region information EA. In more detail, the gamma block controller 250 turns off a gamma block driver of a non-light emitting region based on the light emitting region information EA, and generates the image data signals DATA1 and DATA2 and transfers the generated image data signals to the gamma block unit 280 according to the position compensated image information PMN. The scan driving controller 260 generates the scan driving control signal CONT2 for transferring a plurality of scan signals to a plurality of scan lines that correspond to the light emitting region based on the light emitting region information EA, and transfers the generated scan driving control signals to the scan driver 270. The gamma block unit 280 and the scan driver 270 display an image in the light emitting region.

The operation of the driving circuit 200*a* in the normal state is the same as that of the first exemplary embodiment.

Figure 7:
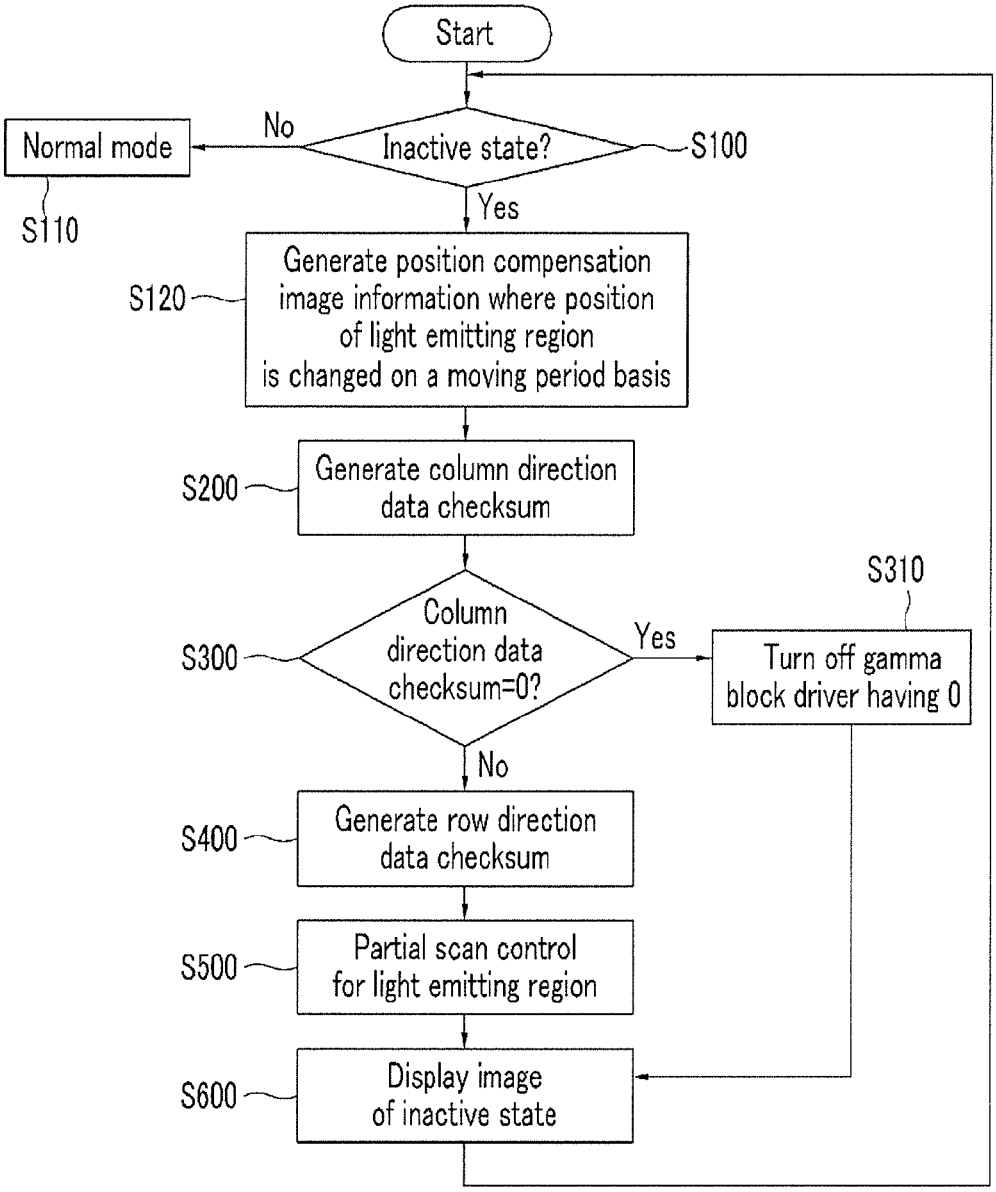
FIG. 7 is a flowchart illustrating an operation of the OLED display according to the second exemplary embodiment of the present invention.

FIG. 7 is a flowchart illustrating an operation of the OLED display according to the second exemplary embodiment of the present invention. In the operation of the OLED display according to the second exemplary embodiment of the present invention, the step of generating the position compensated image information PMN for changing the position of a light emitting region on a moving-period basis (S120) is further included between the inactive state determination step (S100) and the column direction data checksum step (S200), when compared to the first exemplary embodiment of the present invention. The remaining steps are the same as those of the first exemplary embodiment, and a description thereof is omitted for simplicity.

Figure 8A:
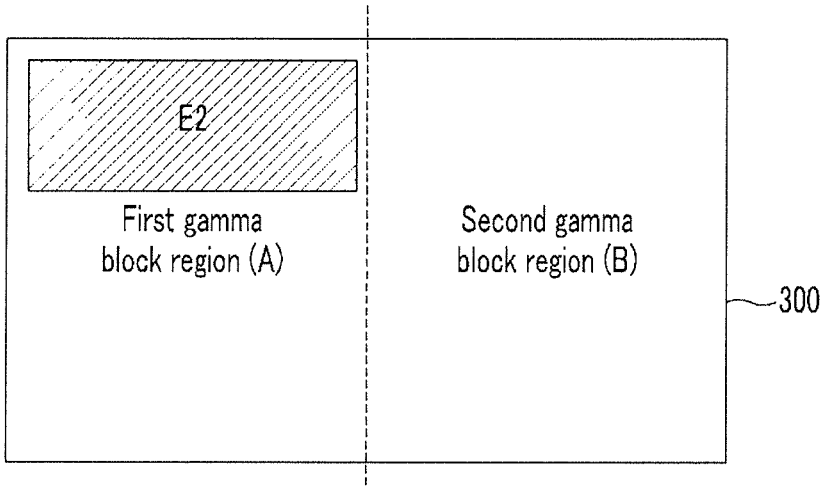
FIGS. 8A and 8B are diagrams showing that the position of a region E2 where an image is displayed is changed in the OLED display according to the second exemplary embodiment of the present invention.
Figure 8B:
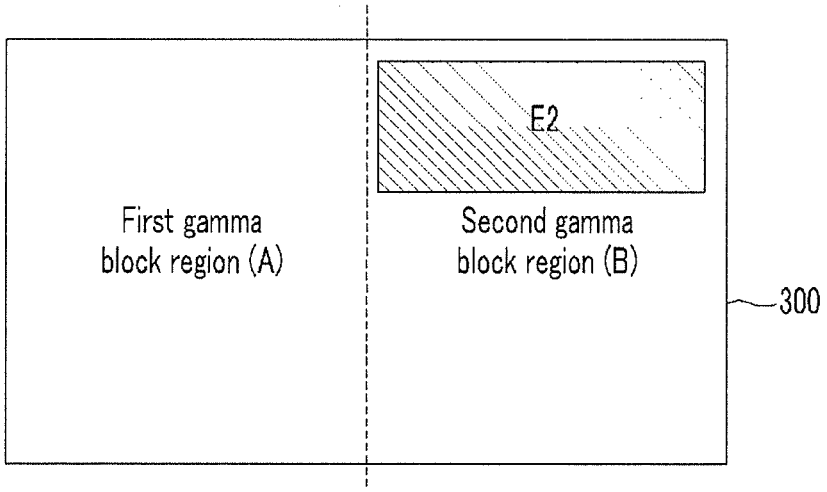

FIGS. 8A and 8B are diagrams showing that the position of a region E2 where an image is displayed is changed in the OLED display according to the second exemplary embodiment of the present invention.

As shown in FIG. 8A, when an inactive state starts, the light emitting region E2 is placed at the top of the first gamma block region A. After a lapse of a moving period, the light emitting region E2 is placed at the top of the second gamma block region B as shown in FIG. 8B. FIGS. 8A and 8B are only illustrative for better understanding and ease of description, and the present invention is not limited thereto. The position of the light emitting region E2 can be changed in various ways.

Like the second exemplary embodiment, a third exemplary embodiment for preventing or reducing the image sticking phenomenon is described below. In the third exemplary embodiment of the present invention, a constituent element for performing compensated color and reversal operations on an image that is displayed in an inactive state on a color reversal-period basis is included. An OLED display according to the third exemplary embodiment of the present invention is described below with reference to FIG. 9.

Figure 9:
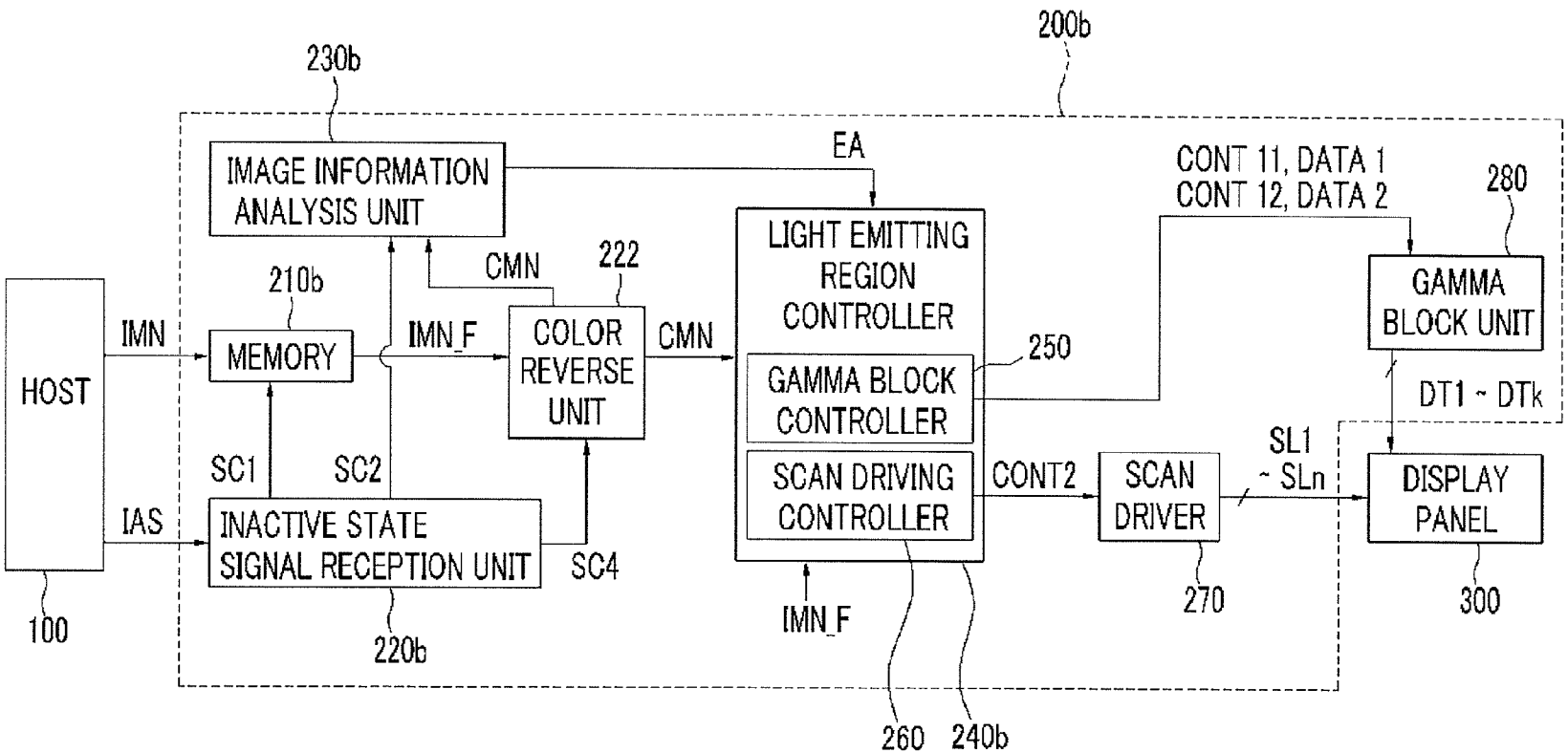
FIG. 9 is a schematic diagram showing an OLED display according to a third exemplary embodiment of the present invention.

FIG. 9 is a schematic diagram showing the OLED display according to the third exemplary embodiment of the present invention. As shown in FIG. 9, the driving circuit 200*b* according to the third exemplary embodiment of the present invention further includes a color reverse unit 222, when compared to the first exemplary embodiment. A redundant description when compared to the first exemplary embodiment is omitted for simplicity.

When the inactive state signal IAS is received, the inactive state signal reception unit 220*b* generates a fourth synchronization signal SC4 together with the first and second synchronization signals SC1 and SC2, and transfers the first and second synchronization signals SC1 and SC2 to the memory 210*b* and the image information analysis unit 230*b*, respectively, and the fourth synchronization signal SC4 to the color reverse unit 222.

The color reverse unit 222 starts an operation in response to the third synchronization signal SC3, receives the image information IMN_F from the memory 210*b*, reverses color information of the image information IMN_F on a color reversal-period basis, and generates color compensated image information CMN. The color compensated image information CMN includes color information about a compensated color on a color reversal-period basis.

During the inactive state, the image information analysis unit 230*b* receives the color compensated image information CMN from the color reverse unit 222, analyzes the received color compensated image information CMN, and generates the light emitting region information EA. A method for the image information analysis unit 230*b* to generate the light emitting region information EA is the same as that of the first exemplary embodiment.

In an inactive state, the light emitting region controller 240*b* receives the color compensated image information CMN about a compensated color on a color reversal-period basis, and controls the gamma block unit 280 and the scan driver 270 based on the color compensated image information CMN and the light emitting region information EA. In more detail, the gamma block unit 280 turns off a gamma block driver corresponding to a non-light emitting region based on the light emitting region information EA, generates the image data signals DATA1 and DATA2 based on the color compensated image information CMN, and outputs the generated image data signals to a gamma block driver corresponding to a light emitting region. The scan driving controller 260 generates the scan driving control signal CONT2 for transferring a plurality of scan signals to a plurality of scan lines corresponding to the light emitting region based on the light emitting region information EA, and transfers the generated scan driving control signal to the scan driver 270. Then, the gamma block unit 280 and the scan driver 270 display an image in the light emitting region.

The operation of the driving circuit in the normal state is the same as that of the first exemplary embodiment.

Figure 10:
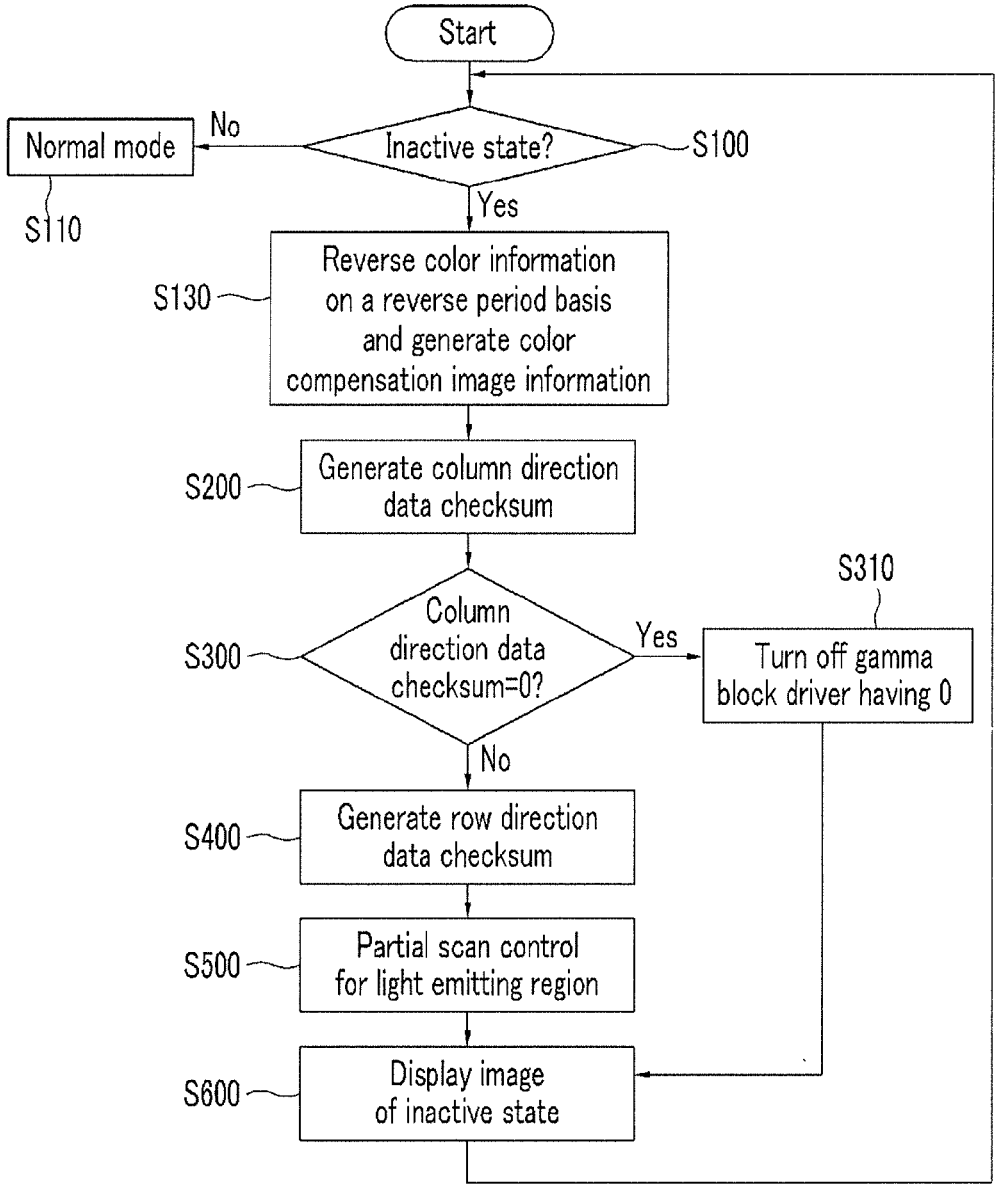
FIG. 10 is a flowchart illustrating an operation of the OLED display according to the third exemplary embodiment of the present invention.

FIG. 10 is a flowchart illustrating an operation of the OLED display according to the third exemplary embodiment of the present invention. The operation of the OLED display according to the third exemplary embodiment of the present invention further includes generating (S130) color compensated image information CMN on a color reversal-period basis between determining the inactive state determination (S100) and the column direction data checksum (S200), when compared to the first exemplary embodiment of the present invention. The remaining parts of the method are the same as those of the first exemplary embodiment, and a description thereof is omitted.

Figure 11A:
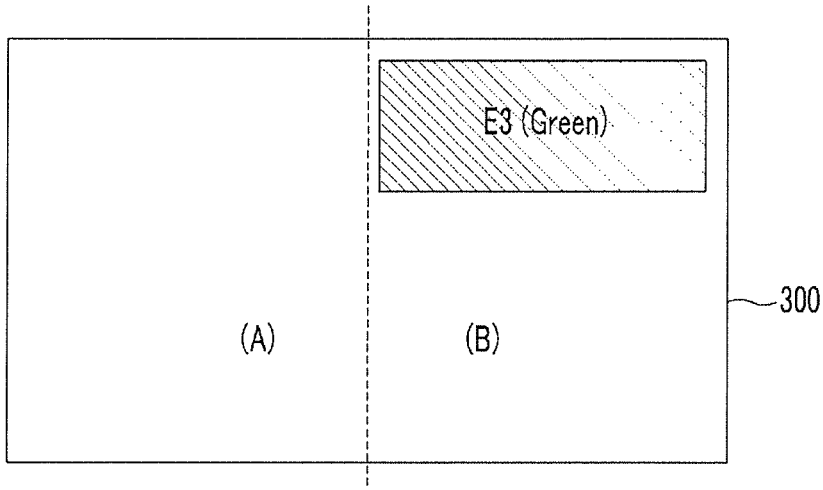
FIGS. 11A and 11B are diagrams showing that the color of a light emitting region E3 where an image is displayed is changed in the OLED display according to the third exemplary embodiment of the present invention.
Figure 11B:
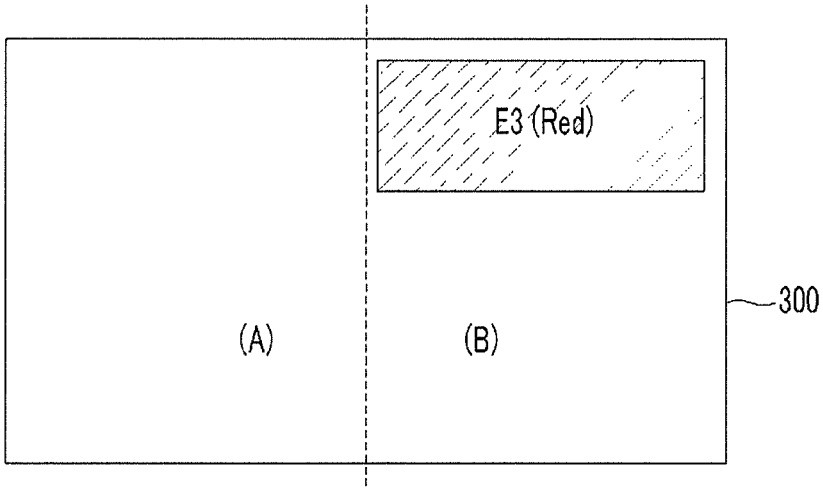

FIGS. 11A and 11B are diagrams showing that the color of a light emitting region E3 where an image is displayed is changed in the OLED display according to the third exemplary embodiment of the present invention.

As shown in FIG. 11A, when an inactive state starts, the light emitting region E3 has a green background. After the reversal period elapses, the light emitting region E3 has a red background as shown in FIG. 11B. After the reversal period elapses again, the light emitting region E3 has a green background as shown in FIG. 11A.

A fourth exemplary embodiment of the present invention relates to an OLED display for displaying an image such that the image flows in a constant direction within a light emitting region in order to prevent or reduce the image of the light emitting region from being fixed for a long period of time in an inactive state. Hereinafter, the OLED display according to the fourth exemplary embodiment of the present invention is described with reference to FIGS. 12 to 14.

Figure 12:
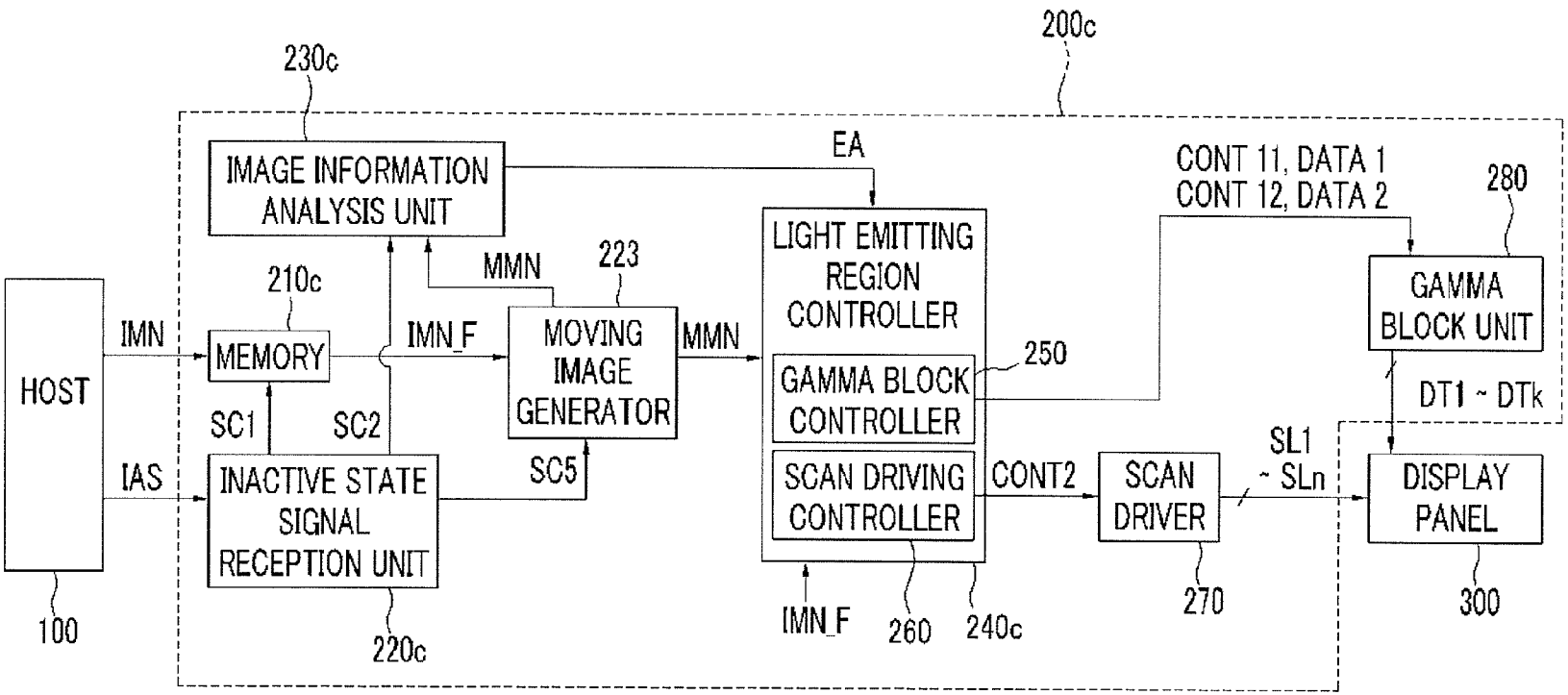
FIG. 12 is a schematic diagram showing an OLED display according to a fourth exemplary embodiment of the present invention.

FIG. 12 is a schematic diagram showing the OLED display according to the fourth exemplary embodiment of the present invention. As shown in FIG. 12, the driving circuit 200*c* according to the fourth exemplary embodiment of the present invention further includes a moving image generator 223, when compared to the first exemplary embodiment. A redundant description of the driving circuit 200*c* when compared to the first exemplary embodiment is omitted for simplicity.

When the inactive state signal IAS is received, the inactive state signal reception unit 220*c* generates a fifth synchronization signal SC5 together with the first and second synchronization signals SC1 and SC2, and transfers the first and second synchronization signals SC1 and SC2 to the memory 210*c* and the image information analysis unit 230*c*, respectively, and the fifth synchronization signal SC5 to the moving image generator 223.

The moving image generator 223 starts operating in response to the fifth synchronization signal SC5, receives the image information IMN_F from the memory 210*c*, changes the image information IMN_F such that an image displayed based on the image information IMN_F is moved according to the lapse of time within a light emitting region, and generates moving compensated image information MMN. In this case, unlike the second exemplary embodiment in which a light emitting region is moved, in the fourth exemplary embodiment, a light emitting region is fixed, and an image displayed within the light emitting region is moved.

During the inactive state, the image information analysis unit 230*c* analyzes the moving compensated image information MMN received from the moving image generator 223 and generates the light emitting region information EA. A method for the image information analysis unit 230*c* to generate the light emitting region information EA is the same as that of the first exemplary embodiment.

The light emitting region controller 240*c* receives the moving compensated image information MMN from the moving image generator 223 during the inactive state, and controls the gamma block unit 280 and the scan driver 270 based on the moving compensated image information MMN and the light emitting region information EA. In more detail, the gamma block controller 250 turns off a gamma block driver corresponding to a non-light emitting region based on the light emitting region information EA, generates the image data signals DATA1 and DATA2 based on the moving compensated image information MMN, and transfers the generated image data signals to the gamma block unit 280. The scan driving controller 260 generates the scan driving control signal CONT2 for transferring a plurality of scan signals to a plurality of scan lines corresponding to a light emitting region based on the light emitting region information EA, and transfers the generated scan driving control signal to the scan driver 270. The gamma block unit 280 and the scan driver 270 display an image in the light emitting region.

The operation of the driving circuit in the normal state is the same as that of the first exemplary embodiment.

Figure 13:
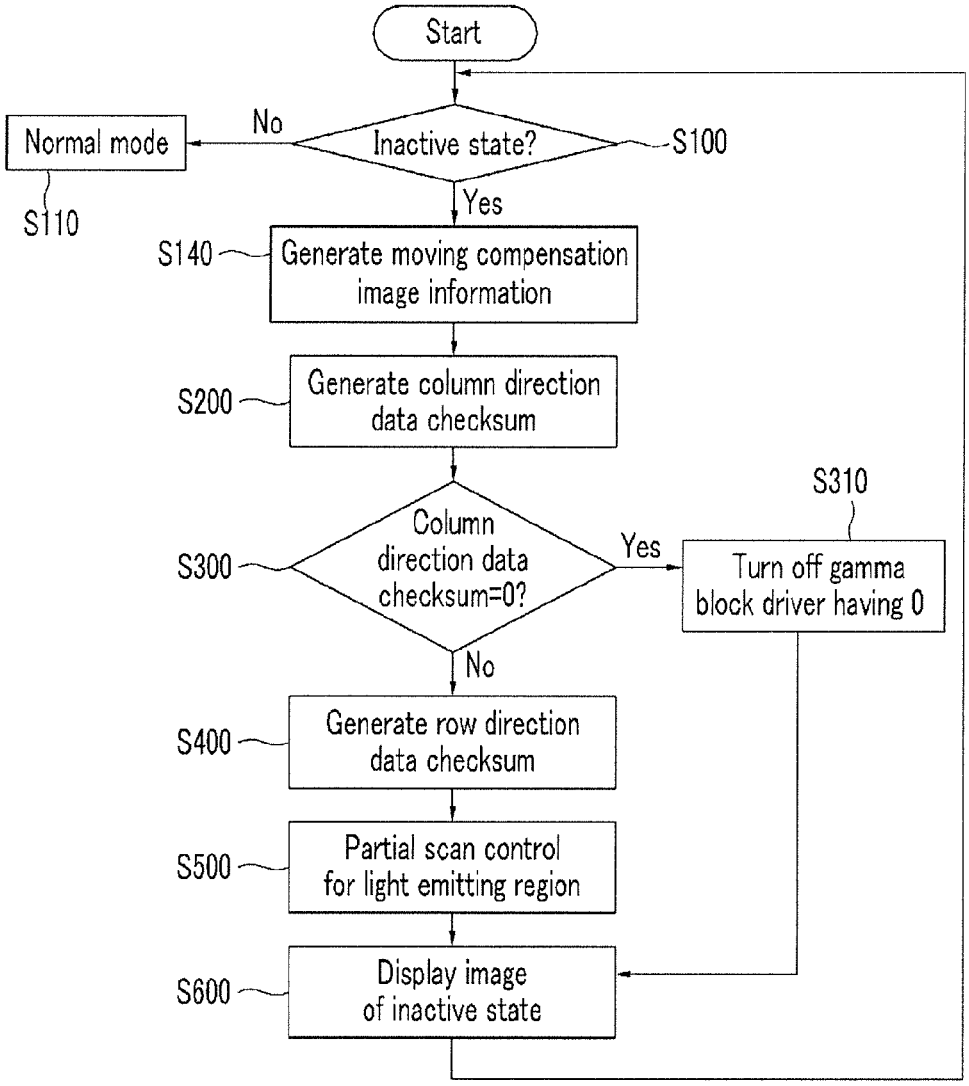
FIG. 13 is a flowchart illustrating an operation of the OLED display according to the fourth exemplary embodiment of the present invention.

FIG. 13 is a flowchart illustrating an operation of the OLED display according to the fourth exemplary embodiment of the present invention. The operation of the OLED display according to the fourth exemplary embodiment of the present invention further includes generating (S140) the moving compensated image information MMN between the inactive state determination (S100) and the column direction data checksum (S200), when compared to the first exemplary embodiment of the present invention. The remaining parts of the method are the same as those of the first exemplary embodiment, and a description thereof is omitted for simplicity.

Figure 14A:
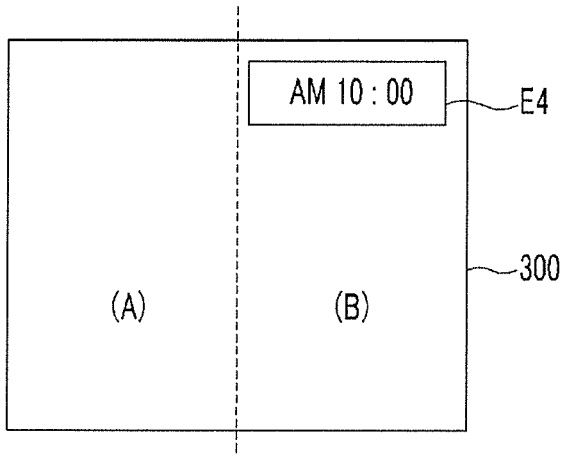
FIGS. 14A and 14B are diagrams showing that an image is moved in a light emitting region E4 where an image is displayed in the OLED display according to the fourth exemplary embodiment of the present invention.
Figure 14B:
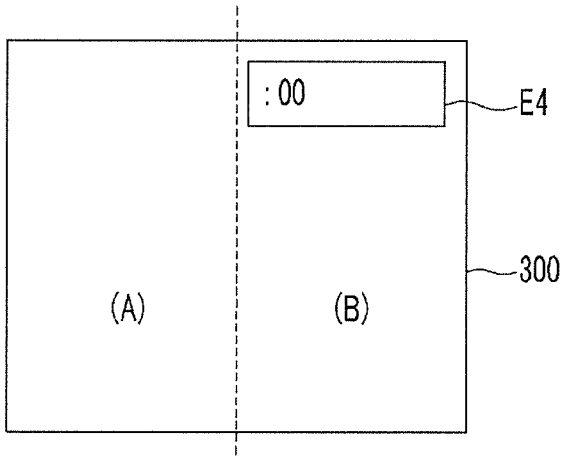

FIGS. 14A and 14B are diagrams showing that an image is moved in a light emitting region E4 where the image is displayed in the OLED display according to the fourth exemplary embodiment of the present invention.

As shown in FIG. 14A, time is displayed in the light emitting region E4 at a point in time at which an inactive state starts. After such display, the time starts moving to the left and, after a lapse of some time, the time is displayed as shown in FIG. 14B. At a point in time at which the display of the time disappears, the time starts being displayed from the right side. In other words, the time appears to move or scroll across the light emitting region E4. It is to be noted that, although the image of the light emitting region E4 is illustrated to be time in FIGS. 14A and 14B for better understanding and ease of description, information such as a date other than time can be displayed.

In the fifth exemplary embodiment of the present invention, in order to prevent or reduce an image displayed in a light emitting region from being fixed for a long period of time in an inactive state, image luminance within the light emitting region is reduced after a lapse of a standby period. Hereinafter, the OLED display according to the fifth exemplary embodiment of the present invention is described with reference to FIGS. 15 to 17.

Figure 15:
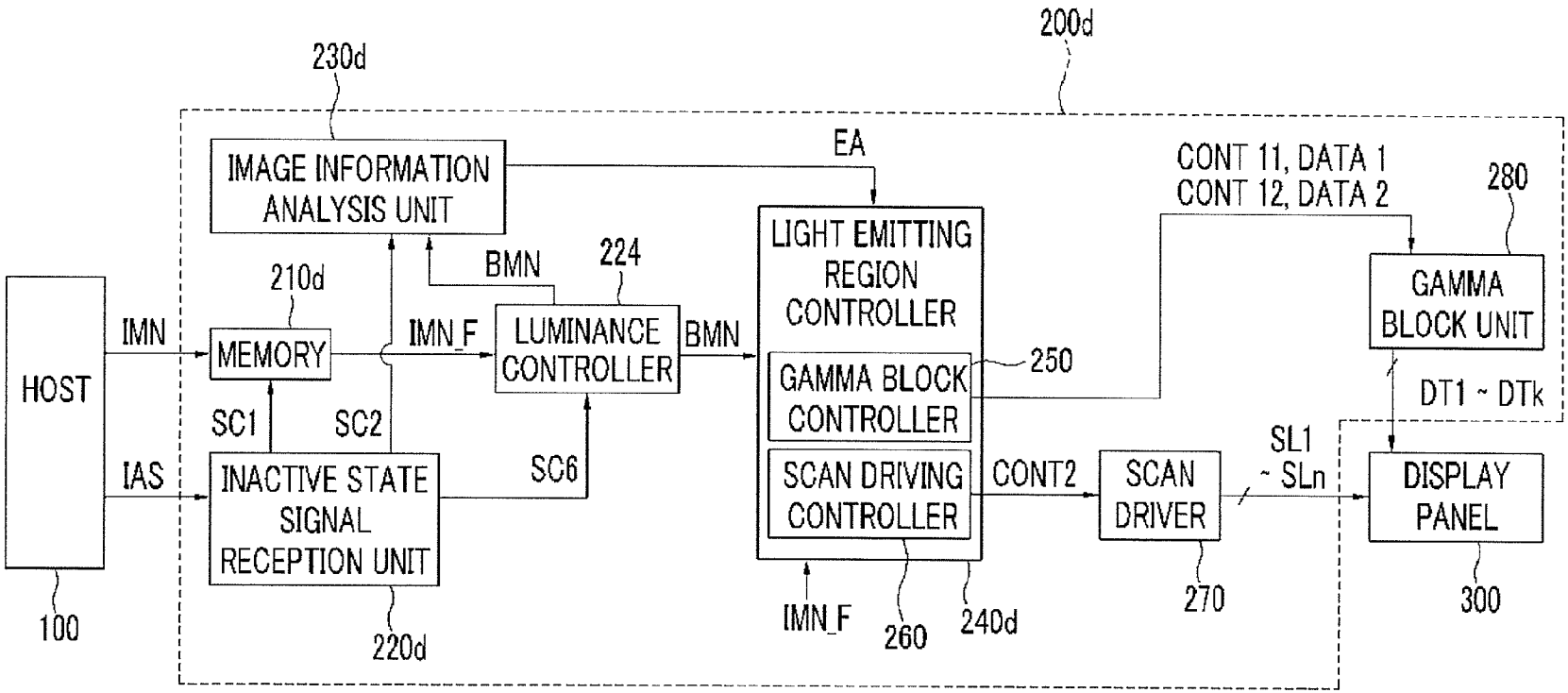
FIG. 15 is a schematic diagram showing an OLED display according to a fifth exemplary embodiment of the present invention.

FIG. 15 is a schematic diagram showing the OLED display according to the fifth exemplary embodiment of the present invention. As shown in FIG. 15, the driving circuit 200*d* according to the fifth exemplary embodiment of the present invention further includes a luminance controller 224, when compared to the first exemplary embodiment. A redundant description when compared to the first exemplary embodiment is omitted for simplicity.

When the inactive state signal IAS is received, the inactive state signal reception unit 220*d* generates a sixth synchronization signal SC6 together with the first and second synchronization signals SC1 and SC2, and transfers the first and second synchronization signals SC1 and SC2 to the memory 210*d* and the image information analysis unit 230*d*, respectively, and the sixth synchronization signal SC6 to the luminance controller 224.

The luminance controller 224 starts operating in response to the sixth synchronization signal SC6, and receives the image information IMN_F from the memory 210*d*. After a lapse of a standby period, the luminance controller 224 changes the image information IMN_F so that the luminance of a displayed image is reduced, and generates luminance compensated image information BMN. Here, the degree that the luminance is reduced is previously set in the luminance controller 224. The luminance of an image can be controlled so that it is slowly reduced to a predetermined threshold value according to a lapse of time since the standby period.

During the inactive state, the image information analysis unit 230*d* analyzes the luminance compensated image information BMN received from the luminance controller 224 and generates the light emitting region information EA. A method for the image information analysis unit 230*d* to generate the light emitting region information EA is the same as that of the first exemplary embodiment. Although the luminance compensated image information BMN is illustrated to be received from the luminance controller 224 in FIG. 15, the image information analysis unit 230*d* can receive the image information IMN_F from the memory 210*d* in order to detect a light emitting region.

The light emitting region controller 240*d* receives the luminance compensated image information BMN during the inactive period, and controls the gamma block unit 280 and the scan driver 270 based on the luminance compensated image information BMN and the light emitting region information EA. In more detail, the gamma block controller 250 turns off a gamma block driver corresponding to a non-light emitting region based on the light emitting region information EA, generates the image data signals DATA1 and DATA2 based on the luminance compensated image information BMN, and transfers the generated data signals to the gamma block unit 280. The scan driving controller 260 generates the scan driving control signal CONT2 for transferring a plurality of scan signals to a plurality of scan lines corresponding to a light emitting region based on the light emitting region information EA, and transfers the generated scan driving control signal to the scan driver 270. The gamma block unit 280 and the scan driver 270 display an image in the light emitting region.

The operation of the driving circuit in the normal state is the same as that of the first exemplary embodiment.

Figure 16:
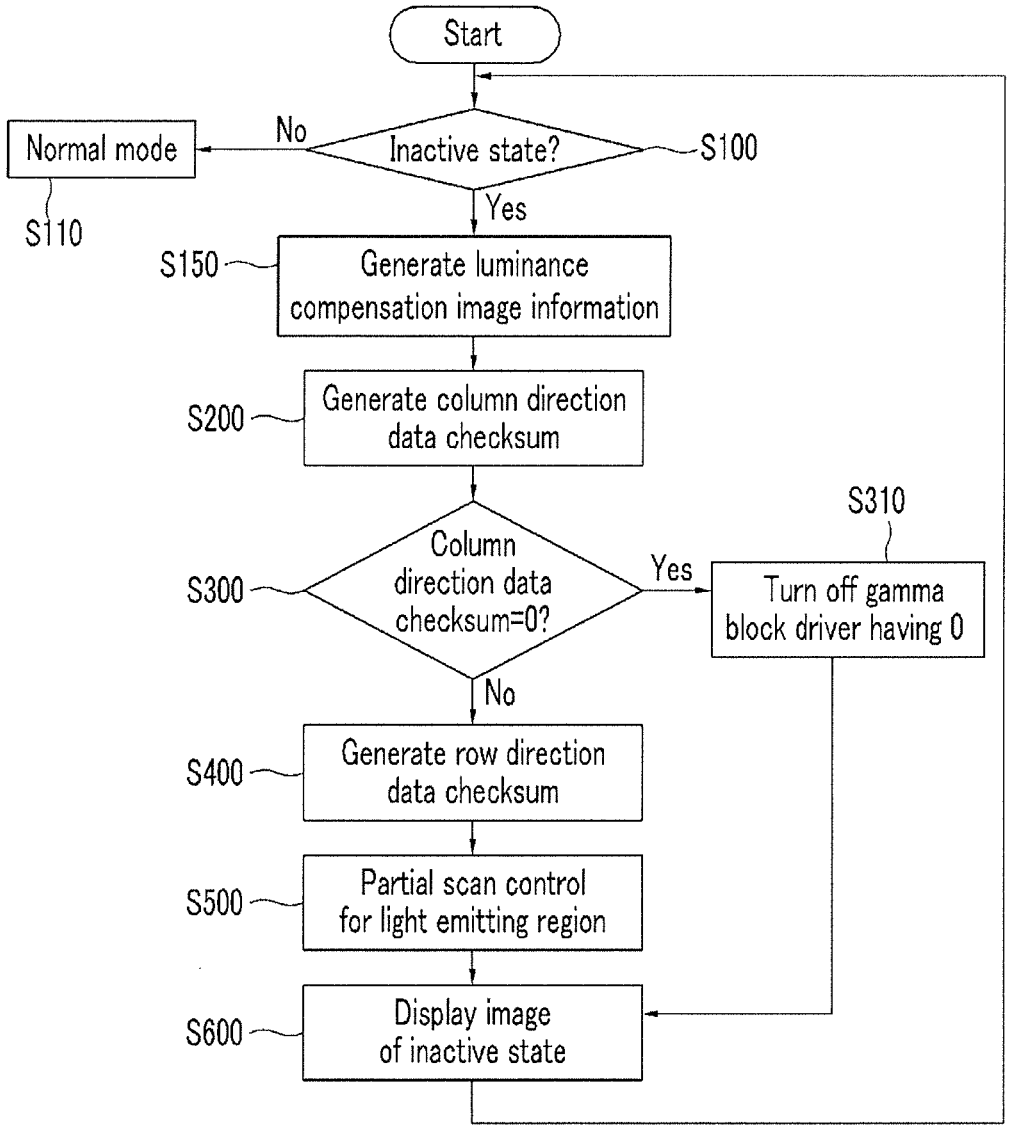
FIG. 16 is a flowchart illustrating an operation of the OLED display according to the fifth exemplary embodiment of the present invention.

FIG. 16 is a flowchart illustrating an operation of the OLED display according to the fifth exemplary embodiment of the present invention. The operation of the OLED display according to the fifth exemplary embodiment of the present invention further includes the step (S150) of generating the luminance compensated image information BMN between the inactive state determination step (S100) and the column direction data checksum step (S200), when compared to the first exemplary embodiment of the present invention. The remaining steps are the same as those of the first exemplary embodiment, and a description thereof is omitted for simplicity.

Figure 17A:
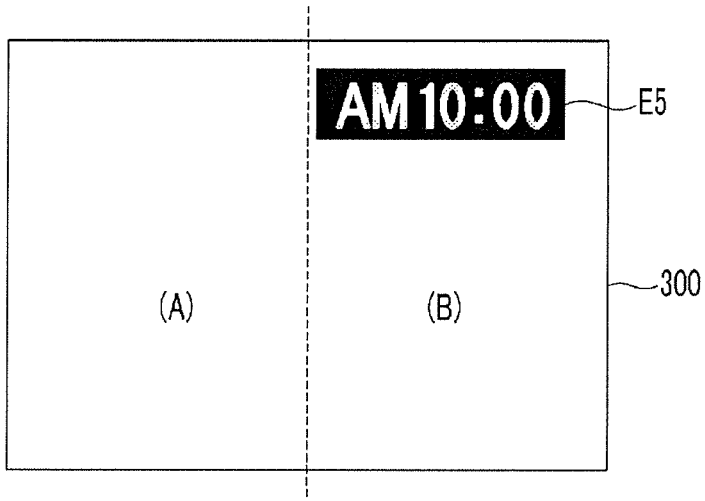
FIGS. 17A and 17B are diagrams showing that luminance is reduced in a light emitting region E5 where an image is displayed in the OLED display according to the fifth exemplary embodiment of the present invention.
Figure 17B:
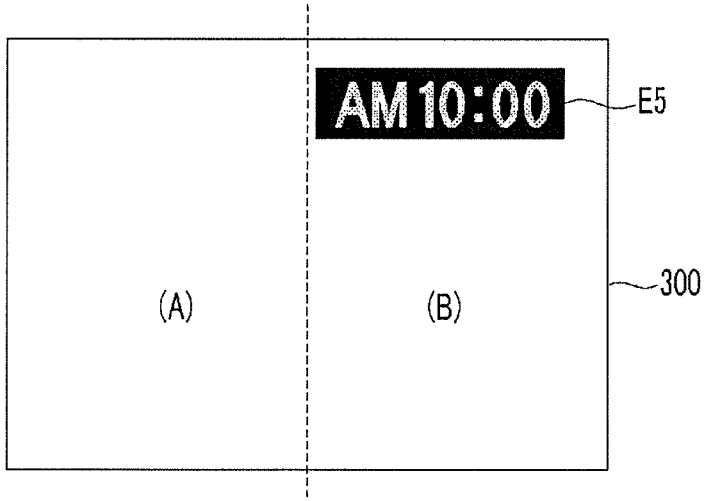

FIGS. 17A and 17B are diagrams showing that luminance is reduced in a light emitting region E5 where an image is displayed in the OLED display according to the fifth exemplary embodiment of the present invention.

As shown in FIG. 17A, the luminance of the time displayed in the light emitting region E5 at a point in time at which an inactive state starts is higher than the luminance of the time displayed in the light emitting region E5 after a standby period shown in FIG. 17B. That is, it can be seen that after the standby period, the luminance of the time displayed in the light emitting region E5 is reduced.

As described above, according to the exemplary embodiments of the present invention, in the inactive state, power consumption can be reduced and an image sticking phenomenon can be prevented or reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An organic light emitting diode (OLED) display, comprising:

a display panel, comprising a plurality of scan lines configured to transfer a plurality of scan signals, a plurality of data lines configured to transfer a plurality of data signals, and a plurality of pixels formed at respective regions where the plurality of scan lines and the plurality of data lines cross; and a driving circuit configured to generate the plurality of data signals and the plurality of scan signals based on image information stored in a memory, wherein the driving circuit is configured to generate, in response to an inactive state signal that is generated when the image information is a still image, only a plurality of scan signals corresponding to a light emitting region in which the still image is displayed and only a plurality of data signals corresponding to the light emitting region in which the still image is displayed, and to transfer the generated scan and data signals to corresponding ones of the data lines and corresponding ones of the scan lines, respectively.

2. The OLED display of claim 1, wherein the driving circuit comprises a gamma block unit configured to generate the plurality of data signals, wherein the gamma block unit comprises at least two gamma block drivers, wherein the display panel comprises at least two gamma block regions respectively corresponding to the at least two gamma block drivers, and wherein the driving circuit is configured to:

when the inactive state signal is received, detect a gamma block region that does not emit light from among the at least two gamma block regions by analyzing the image information; and turn off a gamma block driver corresponding to the detected gamma block region.

3. The OLED display of claim 2, wherein the driving circuit further comprises a scan driver configured to generate the plurality of scan signals to be applied to a plurality of scan lines corresponding to the light emitting region in accordance with an analysis of the image information.

4. The OLED display of claim 3, wherein the driving circuit further comprises an image information analysis unit configured to perform a column direction data checksum for the image information in a column direction along which the data lines extend in the display panel, to perform a row direction data checksum for the image information in a row direction along which the scan lines extend in the display panel, and to generate light emitting region information comprising information about the gamma block driver corresponding to the gamma block region that does not emit light based on the result of the column direction data checksum and information about the plurality of scan signals corresponding to the light emitting region based on the result of the row direction data checksum.

5. The OLED display of claim 4, wherein the image information analysis unit is configured to generate the light emitting region information comprising information about a gamma block driver corresponding to a gamma block region whose column direction data checksum result is 0, from among the at least two gamma block drivers.

6. The OLED display of claim 5, wherein the image information analysis unit is configured to generate the light emitting region information comprising information about the plurality of scan signals corresponding to a region whose row direction data checksum result is not 0.

7. The OLED display of claim 6, wherein first and second synchronization signals synchronized to the inactive state signal are transferred to the memory and the image information analysis unit, respectively, the memory transfers the image information to the image information analysis unit on a frame basis in response to the first synchronization signal, and the image information analysis unit operates in response to the second synchronization signal.

8. The OLED display of claim 3, wherein the driving circuit further comprises:

a gamma block controller configured to control the at least two gamma block drivers; and a light emitting region controller comprising a scan driving controller configured to control the scan driver, wherein the gamma block controller is configured to turn off the gamma block driver corresponding to the gamma block region that does not emit light from among the at least two gamma block drivers, and wherein the scan driving controller is configured to control the scan driver so that the plurality of scan signals are sequentially transferred to the plurality of respective scan lines corresponding to the light emitting region.

9. The OLED display of claim 8, wherein the driving circuit comprises an image information analysis unit configured to perform a column direction data checksum for the image information in a column direction along which the data lines extend in the display panel, to perform a row direction data checksum for the image information in a row direction along which the scan lines extend in the display panel, and to generate light emitting region information comprising information about the gamma block driver corresponding to the gamma block region that does not emit light based on the result of the column direction data checksum and information about the plurality of scan signals corresponding to the light emitting region based on the result of the row direction data checksum.

10. The OLED display of claim 9, wherein the image information analysis unit is configured to generate the light emitting region information comprising information about a gamma block driver corresponding to a gamma block region whose column direction data checksum result is 0, from among the at least two gamma block drivers.

11. The OLED display of claim 10, wherein the image information analysis unit is configured to generate the light emitting region information comprising information about a plurality of scan lines corresponding to a region whose row direction data checksum result is not 0.

12. The OLED display of claim 2, wherein each of the at least two gamma block regions is coupled to every scan line of the plurality of the scan lines.

13. The OLED display of claim 1, wherein the driving circuit comprises a gamma block unit configured to generate the plurality of data signals, wherein the gamma block unit comprises at least two gamma block drivers, wherein the display panel comprises at least two gamma block regions respectively corresponding to the at least two gamma block drivers, and wherein the driving circuit is configured to:

when the inactive state signal is received, generate position compensated image information by changing the image information such that a position of the light emitting region is changed on a moving-period basis; detect a gamma block region that does not emit light from among the at least two gamma block regions by analyzing the position compensated image information; turn off a gamma block driver corresponding to the detected gamma block region from among the at least two gamma block drivers; and control the gamma block unit such that a gamma block driver corresponding to the light emitting region from among the at least two gamma block drivers generates the plurality of data signals based on the position compensated image information.

14. The OLED display of claim 13, wherein the driving circuit further comprises a scan driver configured to generate the plurality of scan signals, and wherein the driving circuit is configured to control the scan driver such that the plurality of scan signals are respectively transferred to a plurality of scan lines corresponding to the light emitting region by analyzing the position compensated image information.

15. The OLED display of claim 14, wherein the driving circuit further comprises an image information analysis unit configured to perform a column direction data checksum for the position compensated image information in a column direction along which the data lines extend in the display panel, to perform a row direction data checksum for the position compensated image information in a row direction along which the scan lines extend in the display panel, and to generate light emitting region information comprising information about the gamma block driver corresponding to the gamma block region that does not emit light based on the result of the column direction data checksum and information about the plurality of scan signals corresponding to the light emitting region based on the result of the row direction data checksum.

16. The OLED display of claim 15, wherein the image information analysis unit is configured to generate the light emitting region information comprising information about a gamma block driver corresponding to a gamma block region whose column direction data checksum result is 0, from among the at least two gamma block drivers.

17. The OLED display of claim 16, wherein the image information analysis unit is configured to generate the light emitting region information comprising information about a plurality of scan lines corresponding to a region whose row direction data checksum result is not 0.

18. The OLED display of claim 1, wherein the driving circuit comprises a gamma block unit configured to generate the plurality of data signals, wherein the gamma block unit comprises at least two gamma block drivers, wherein the display panel comprises at least two gamma block regions respectively corresponding to the at least two gamma block drivers, and wherein the driving circuit is configured to:

when the inactive state signal is received, generate color compensated image information by performing color compensated and reversal operations on color information of the image information on a color reversal-period basis; detect a gamma block region that does not emit light from among the at least two gamma block regions by analyzing the color compensated image information; turn off a gamma block driver corresponding to the detected gamma block region: and control the gamma block unit so that a gamma block driver corresponding to the light emitting region from among the at least two gamma block drivers generates the plurality of data signals based on the color compensated image information.

19. The OLED display of claim 18, wherein the driving circuit further comprises a scan driver configured to generate the plurality of scan signals, and wherein the driving circuit is configured to control the scan driver such that the plurality of scan signals are respectively transferred to a plurality of scan lines corresponding to the light emitting region by analyzing the color compensated image information.

20. The OLED display of claim 19, wherein the driving circuit further comprises an image information analysis unit configured to perform a column direction data checksum for the color compensated image information in a column direction along which the data lines extend in the display panel, to perform a row direction data checksum for the color compensated image information in a row direction along which the scan lines extend in the display panel, and to generate light emitting region information comprising information about the gamma block driver corresponding to the gamma block region that does not emit light based on the result of the column direction data checksum and information about the plurality of scan signals corresponding to the light emitting region based on the result of the row direction data checksum.

21. The OLED display of claim 20, wherein the image information analysis unit is configured to generate the light emitting region information comprising information about a gamma block driver corresponding to a gamma block region whose column direction data checksum result is 0, from among the at least two gamma block drivers.

22. The OLED display of claim 21, wherein the image information analysis unit is configured to generate the light emitting region information comprising information about a plurality of scan lines corresponding to a region whose row direction data checksum result is not 0.

23. The OLED display of claim 1, wherein the driving circuit comprises a gamma block unit configured to generate the plurality of data signals, wherein the gamma block unit comprises at least two gamma block drivers, wherein the display panel comprises at least two gamma block regions respectively corresponding to the at least two gamma block drivers, and wherein the driving circuit is configured to:

when the inactive state signal is received, generate moving compensated image information such that an image moves within the light emitting region; detect a gamma block region that does not emit light from among the at least two gamma block regions by analyzing the moving compensated image information; turn off a gamma block driver corresponding to the detected gamma block region; and control the gamma block unit such that a gamma block driver corresponding to the light emitting region from among the at least two gamma block drivers generates the plurality of data signals based on the moving compensated image information.

24. The OLED display of claim 23, wherein the driving circuit further comprises a scan driver configured to generate the plurality of scan signals to be applied to a plurality of scan lines corresponding to the light emitting region in accordance with an analysis of the moving compensated image information.

25. The OLED display of claim 24, wherein the driving circuit further comprises an image information analysis unit configured to: perform a column direction data checksum for the moving compensated image information in a column direction along which the data lines extend in the display panel; perform a row direction data checksum for the moving compensated image information in a row direction along which the scan lines extend in the display panel; and generate light emitting region information comprising information about the gamma block driver corresponding to the gamma block region that does not emit light based on the result of the column direction data checksum and information about the plurality of scan signals corresponding to the light emitting region based on the result of the row direction data checksum.

26. The OLED display of claim 25, wherein the image information analysis unit is configured to generate the light emitting region information comprising information about a gamma block driver corresponding to a gamma block region whose column direction data checksum result is 0, from among the at least two gamma block drivers.

27. The OLED display of claim 26, wherein the image information analysis unit is configured to generate the light emitting region information comprising information about a plurality of scan lines corresponding to a region whose row direction data checksum result is not 0.

28. The OLED display of claim 1, wherein the driving circuit comprises a gamma block unit configured to generate the plurality of data signals, wherein the gamma block unit comprises at least two gamma block drivers, wherein the display panel comprises at least two gamma block regions respectively corresponding to the at least two gamma block drivers, and wherein the driving circuit is configured to:

when the inactive state signal is received, detect luminance compensated image information for decreasing luminance of an image within the light emitting region after a predetermined standby period from a point in time at which the inactive state signal is received; detect a gamma block region that does not emit light from among the at least two gamma block regions by analyzing the luminance compensated image information; turn off a gamma block driver corresponding to the detected gamma block region; and control the gamma block unit such that a gamma block driver corresponding to the light emitting region from among the at least two gamma block drivers generates the plurality of data signals based on the luminance compensated image information.

29. The OLED display of claim 28, wherein the driving circuit further comprises a scan driver configured to generate the plurality of scan signals to be applied to a plurality of scan lines corresponding to the light emitting region in accordance with an analysis of the luminance compensated image information.

30. The OLED display of claim 29, wherein the driving circuit further comprises an image information analysis unit configured to perform a column direction data checksum for the luminance compensated image information in a column direction along which the data lines extend in the display panel, to perform a row direction data checksum for the luminance compensated image information in a row direction along which the scan lines extend in the display panel, and to generate light emitting region information comprising information about the gamma block driver corresponding to the gamma block region that does not emit light based on the result of the column direction data checksum and information about the plurality of scan signals corresponding to the light emitting region based on the result of the row direction data checksum.

31. The OLED display of claim 30, wherein the image information analysis unit is configured to generate the light emitting region information comprising information about a gamma block driver corresponding to a gamma block region whose column direction data checksum result is 0, from among the at least two gamma block drivers.

32. The OLED display of claim 31, wherein the image information analysis unit is configured to generate the light emitting region information comprising information about a plurality of scan lines corresponding to a region whose row direction data checksum result is not 0.

33. A method of driving an OLED display, comprising a display panel comprising a plurality of scan lines for transferring a plurality of scan signals and a plurality of data lines for transferring a plurality of data signals, a memory configured to store image information, and at least two gamma block drivers configured to control at least two gamma block regions of the display panel, respectively, and to transfer the plurality of data signals to each of the respective at least two gamma block regions, comprising:

determining whether an inactive state signal generated when the image information stored in the memory is a still image has been received;

if, as a result of the determination, the inactive state signal is determined to have been received, performing a column direction data checksum for the image information in a column direction where the plurality of data lines extend;

determining whether the column direction data checksum is 0;

turning off a gamma block driver corresponding to a gamma block region whose column direction data checksum is 0, from among the at least two gamma block drivers;

if, as a result of the determination, the inactive state signal is determined to have been received, performing a row direction data checksum for the image information in a row direction where the plurality of scan lines extend; and controlling the plurality of scan signals based on the row direction data checksum such that the plurality of scan signals are sequentially transferred to a plurality of scan lines corresponding to a light emitting region in which the still image is displayed.

34. The method of claim 33, further comprising if, as a result of the determination, the inactive state signal is determined to have been received, changing the image information such that a position of the light emitting region is changed on a moving-period basis and generating position compensated image information, wherein the performing of the column direction data checksum and the performing of the row direction data checksum use the position compensated image information.

35. The method of claim 33, further comprising if, as a result of the determination, the inactive state signal is determined to have been received, generating color compensated image information by performing compensated color and reversal operations on color information of the image information on a color reversal-period basis, wherein the performing of the column direction data checksum and the performing of the row direction data checksum use the color compensated image information.

36. The method of claim 33, further comprising if, as a result of the determination, the inactive state signal is determined to have been received, generating moving compensated image information such that an image flows in a constant direction within the light emitting region, wherein the performing of the column direction data checksum and the performing of the row direction data checksum use the moving compensated image information.

37. The method of claim 33, further comprising if, as a result of the determination, the inactive state signal is determined to have been received, generating luminance compensated image information for decreasing a luminance of an image within the light emitting region after a predetermined standby period from a point in time at which the inactive state signal has been input, wherein the performing of the column direction data checksum and the performing of the row direction data checksum use the luminance compensated image information.

* * * * *